US006943686B2

(12) United States Patent
Allen

(10) Patent No.: US 6,943,686 B2
(45) Date of Patent: Sep. 13, 2005

(54) ADJUSTABLE ALARM DEVICE FOR SLIDING DOORS AND WINDOWS

(76) Inventor: Robert Allen, P.O. Box 16, Parksville, BC (CA), V9P 2G3

( * ) Notice: Subject to any disclaimer, the term of this patent is extended or adjusted under 35 U.S.C. 154(b) by 0 days.

(21) Appl. No.: 10/313,017

(22) Filed: Dec. 6, 2002

(65) Prior Publication Data

US 2003/0141974 A1 Jul. 31, 2003

Related U.S. Application Data

(60) Provisional application No. 60/336,173, filed on Dec. 6, 2001.

(51) Int. Cl.[7] ..... G08B 13/08
(52) U.S. Cl. ..... 340/546; 340/693.5
(58) Field of Search ..... 340/546, 545.1, 340/693.5; 200/61.93

(56) References Cited

U.S. PATENT DOCUMENTS 4,193,067 A * 3/1980 Hawkins ..... 340/546
4,358,758 A * 11/1982 Morton ..... 340/546
4,442,427 A * 4/1984 Morton ..... 340/546
4,472,709 A * 9/1984 White ..... 340/546
4,553,134 A * 11/1985 Holt ..... 340/546
4,607,253 A * 8/1986 Wooten et al. ..... 340/546
4,837,557 A * 6/1989 Striebel ..... 340/546
4,888,578 A * 12/1989 Conemac ..... 340/546
4,896,139 A * 1/1990 Eldridge ..... 340/546
5,340,175 A * 8/1994 Wood ..... 292/339
6,388,572 B1 * 5/2002 Salter ..... 340/546
6,417,770 B1 * 7/2002 Sturznickel ..... 340/546

FOREIGN PATENT DOCUMENTS

GB 2188676 A * 10/1987 ..... E05C/17/30

* cited by examiner

*Primary Examiner*—Thomas Mullen
(74) *Attorney, Agent, or Firm*—Gordon Thomson

(57) ABSTRACT

An adjustable alarm device for windows and doors is installed between the door or window frame and the door or window sash. The longitudinal axis of the alarm device is preferably horizontal. When engaged, movement of the door or window in an open direction will activate the alarm. The body of the alarm device is elongate, tubular and telescoping. The body comprises an outer tube that receives an inner tube. The body of the alarm device may be locked in an extended position by way of a cam mounted on the inner tube and positioned within the body so that when the inner and outer tubes of the body are twisted about their longitudinal axis, the cam body will engage the inner surface of the outer tube in a releasable frictional locking engagement. The alarm device is coupled to one end of the inner tube.

31 Claims, 34 Drawing Sheets

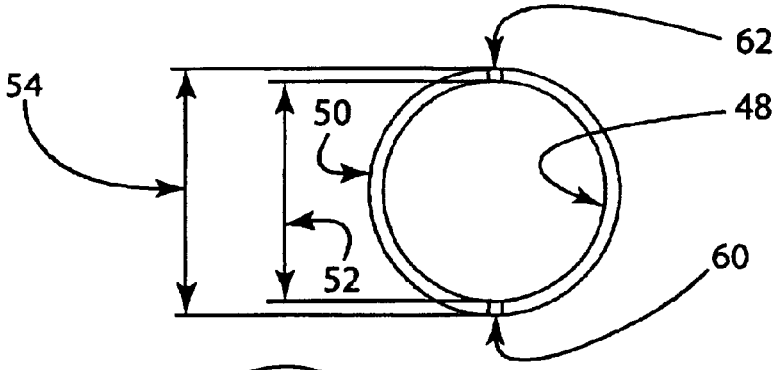
Figure 4 - B
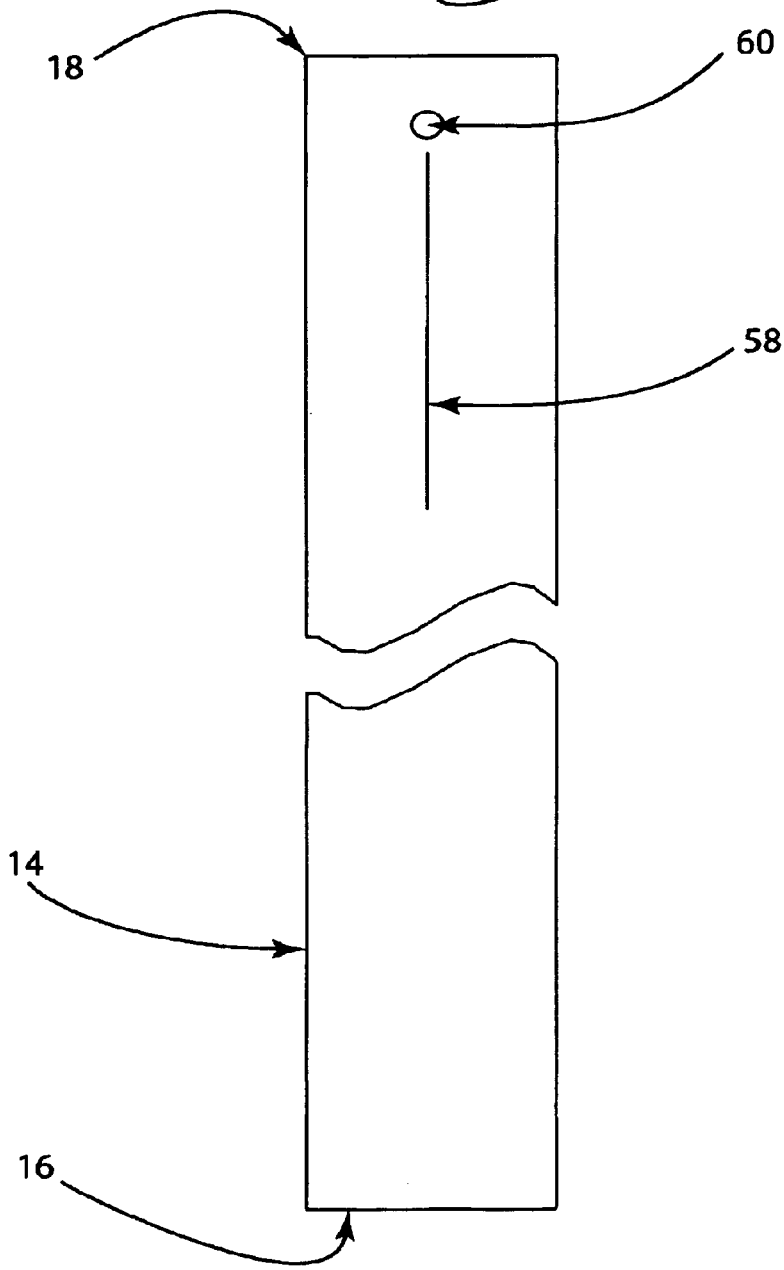
Figure 4 - A

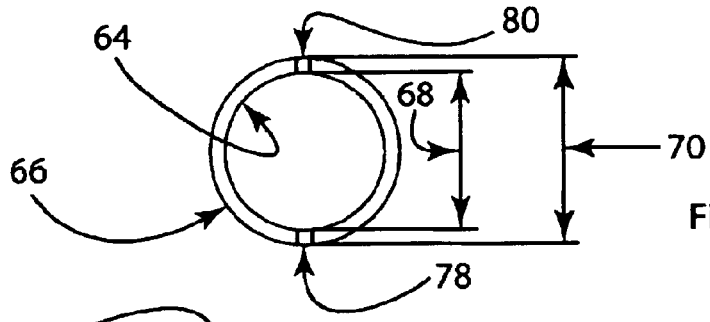
Figure 5 - B
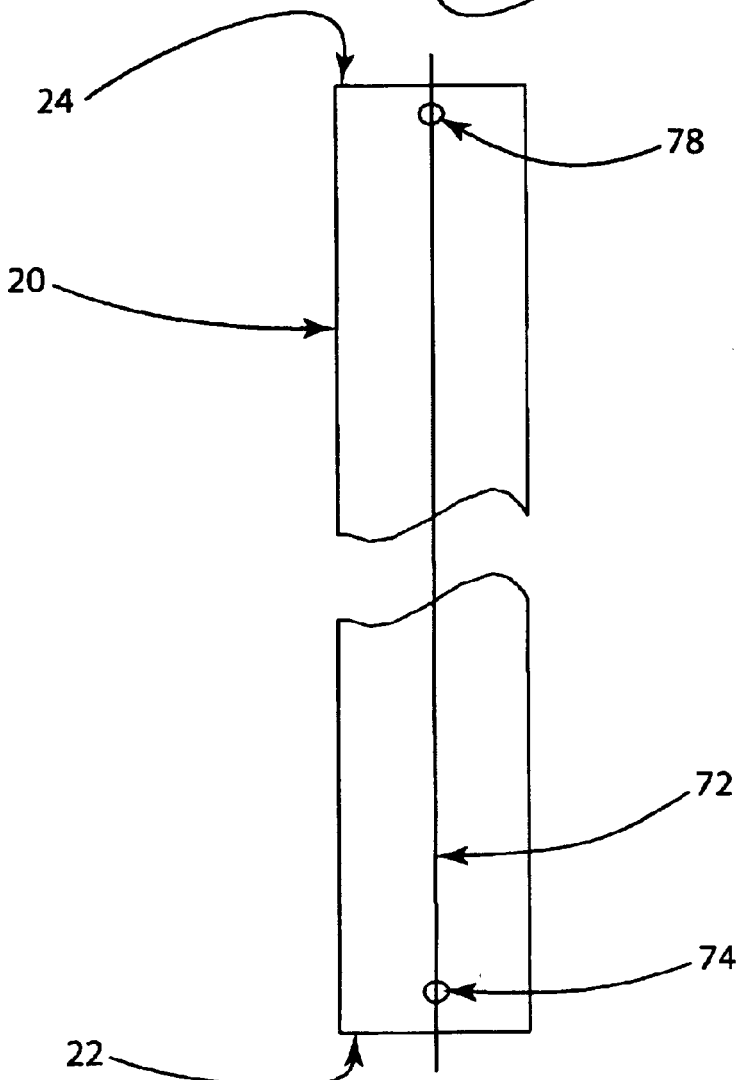
Figure 5 - A
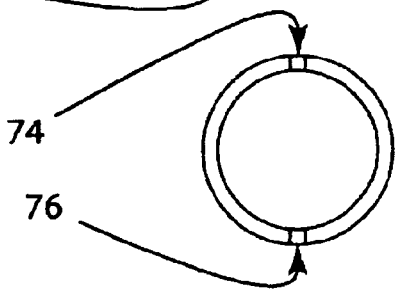
Figure 5 - C

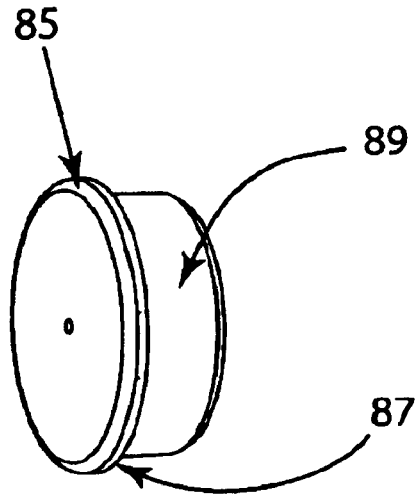
Figure 7 - A
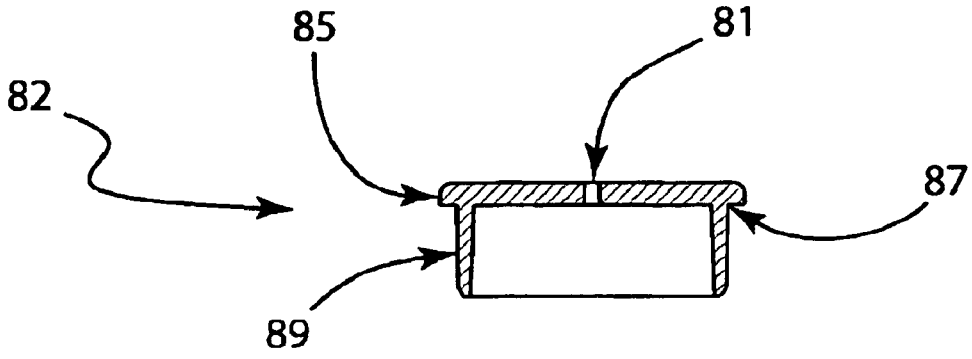
Figure 7 - B

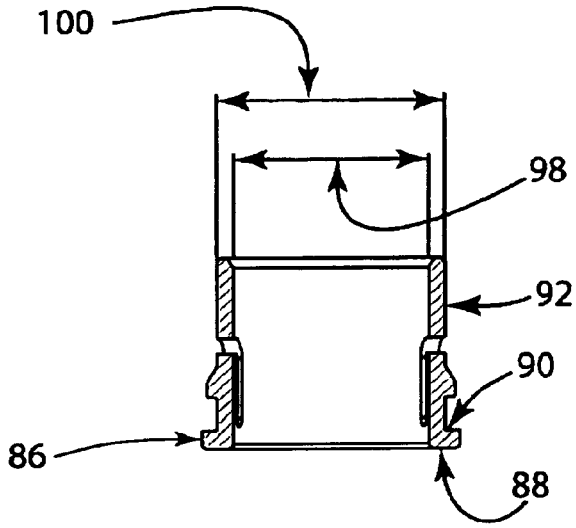
Figure 8 - A
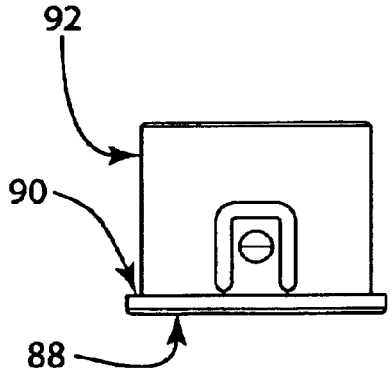
Figure 8 - B
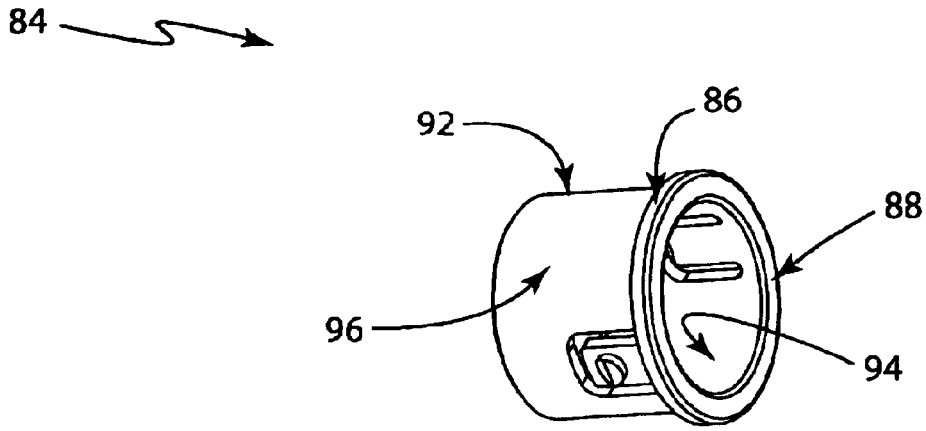
Figure 8 - C

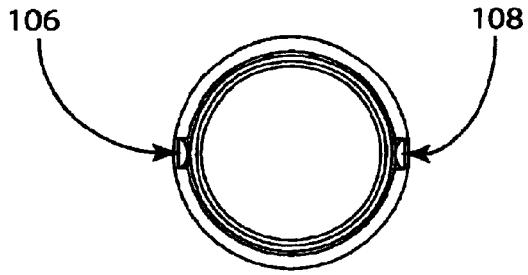
Figure 9A
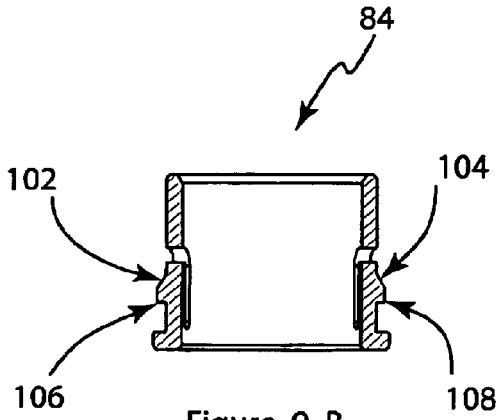
Figure 9-B
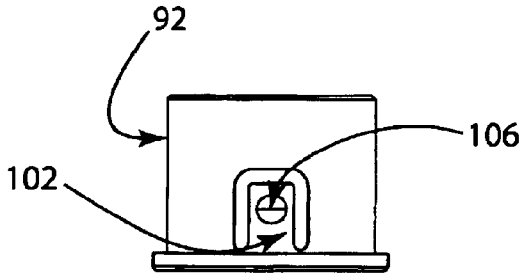
Figure 9-C
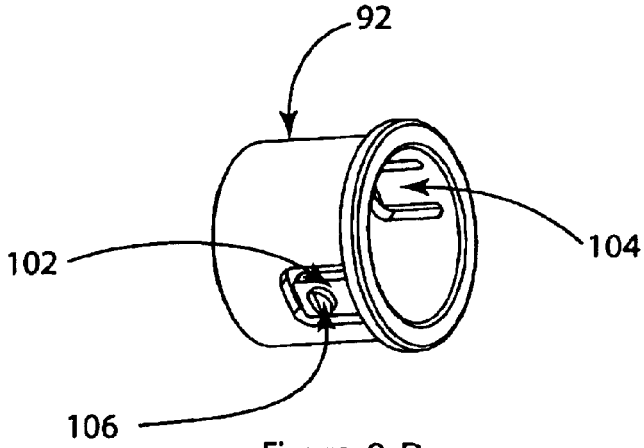
Figure 9-D

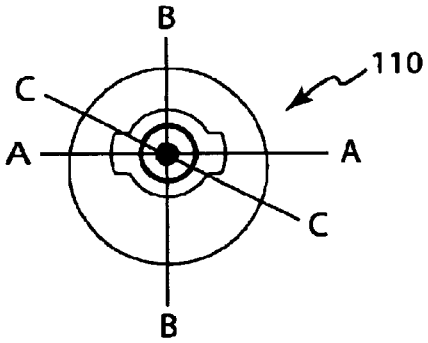
Figure 10-A
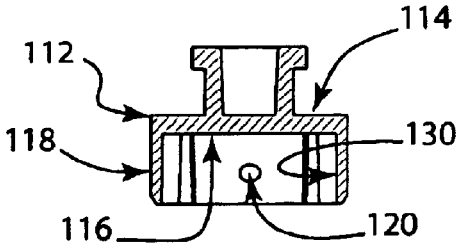
Figure 10-B
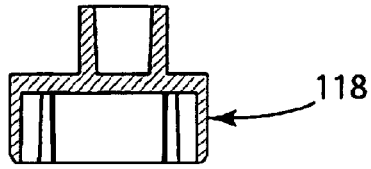
Figure 10-C
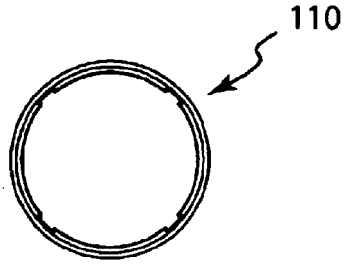
Figure 10-D
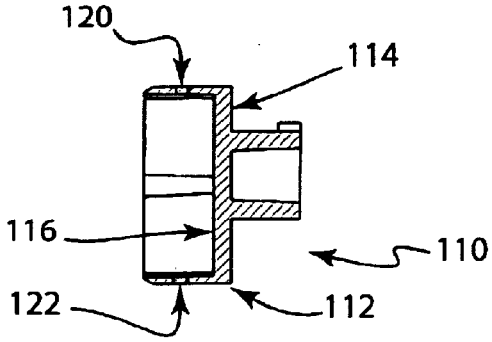
Figure 10-E
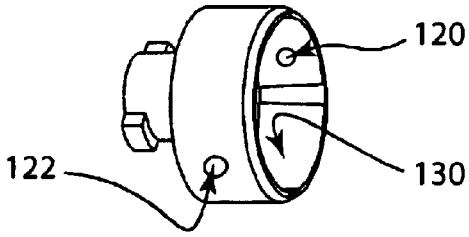
Figure 10-F

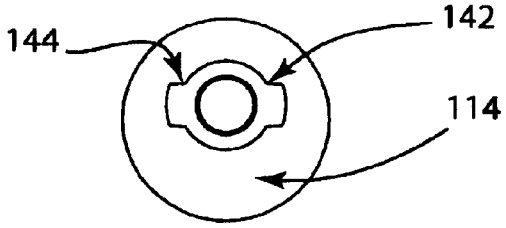
Figure 11 -A
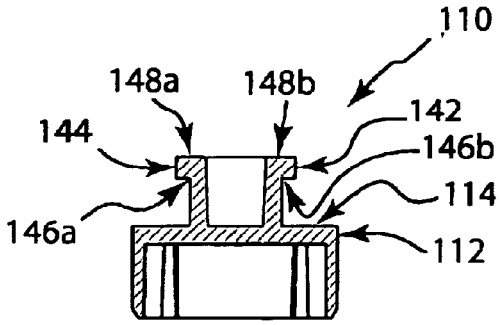
Figure 11 -B
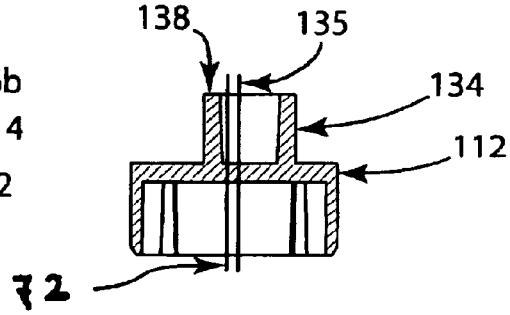
Figure 11 -C
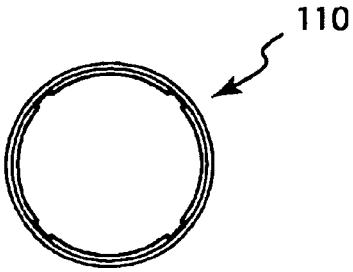
Figure 11 -D
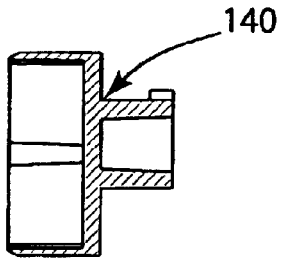
Figure 11 -E
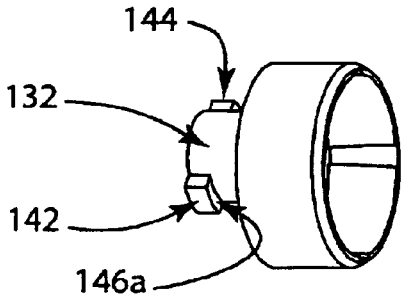
Figure 11 -F

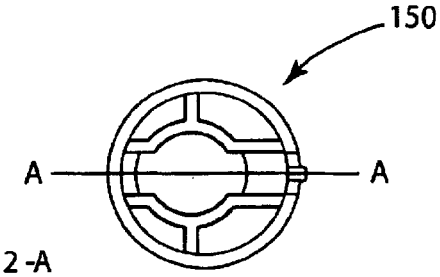
Figure 12-A
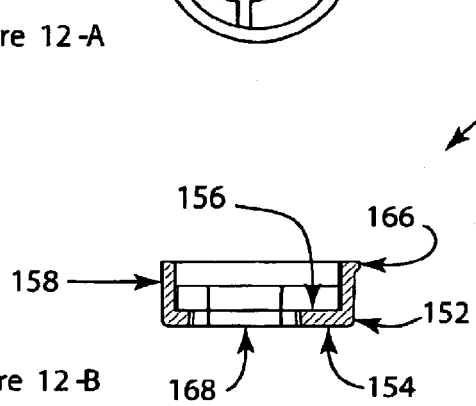
Figure 12-B
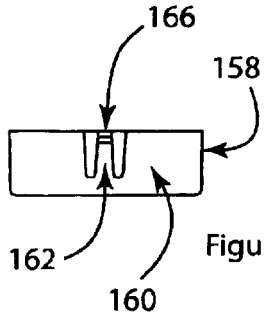
Figure 12-C
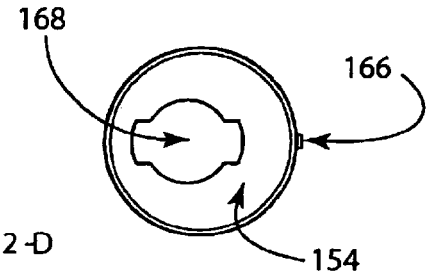
Figure 12-D
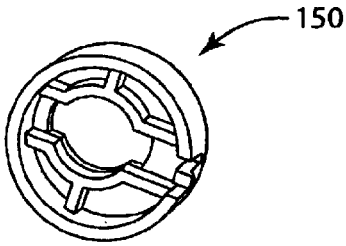
Figure 12-E
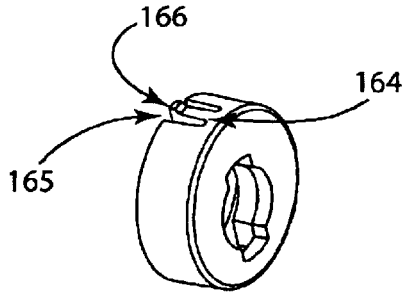
Figure 12-F

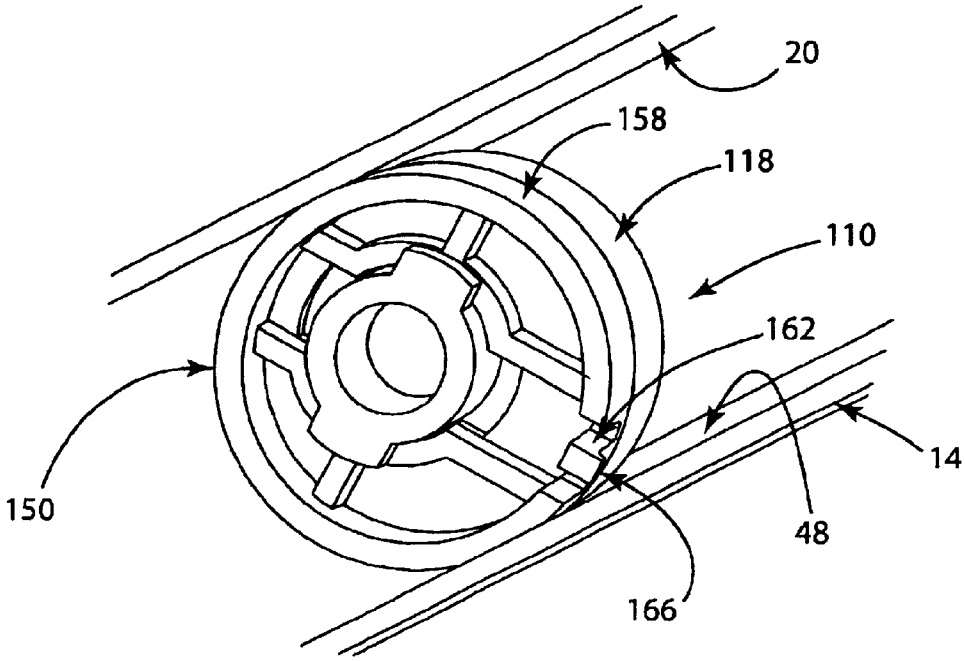
Figure 13-A

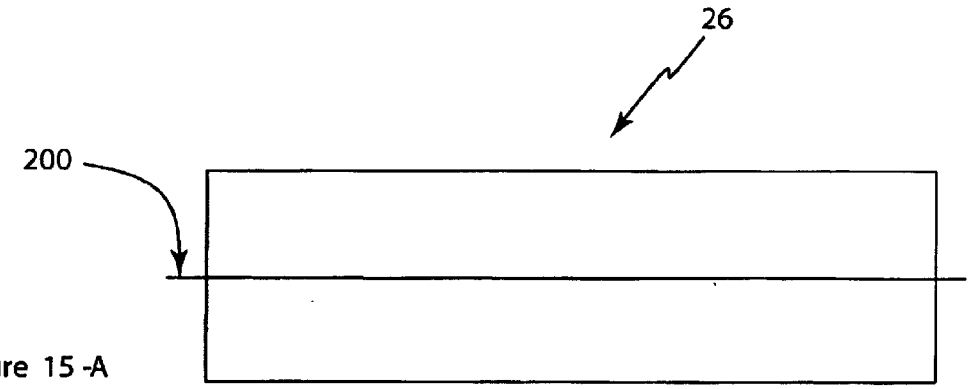
Figure 15-A
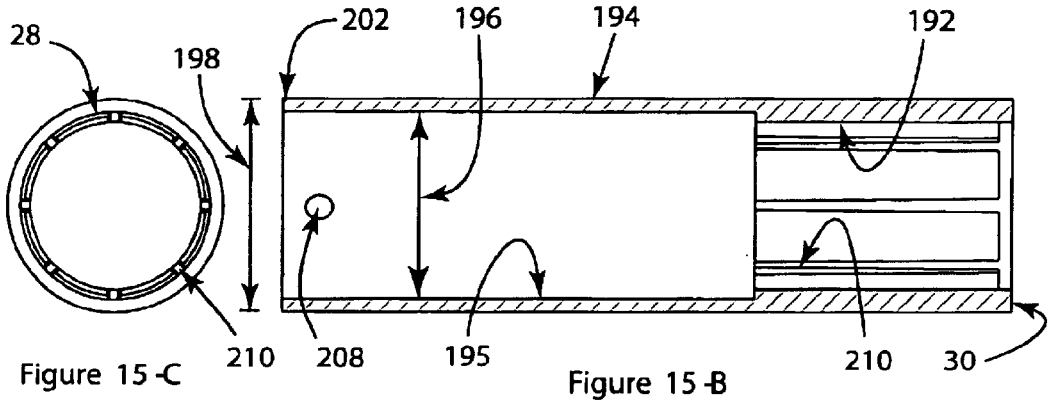
Figure 15-C
Figure 15-B
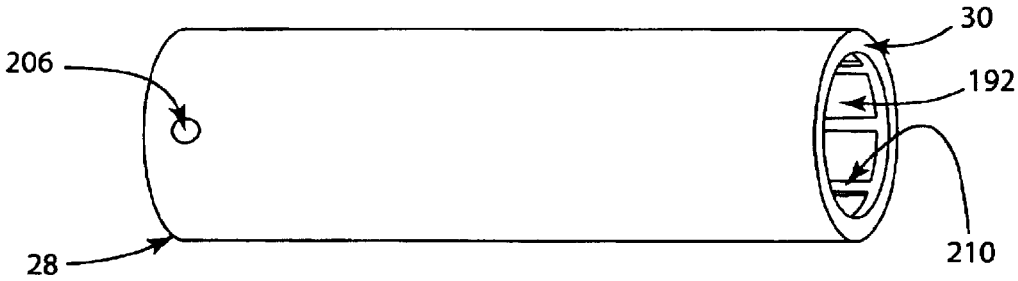
Figure 15-D

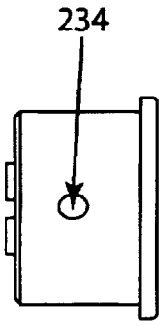
Figure 16-B
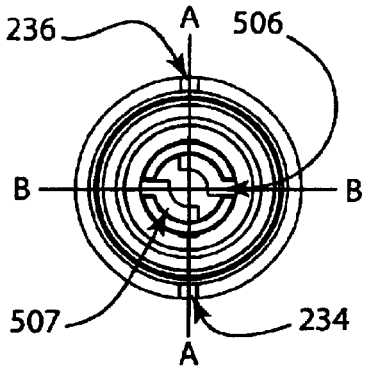
Figure 16-A
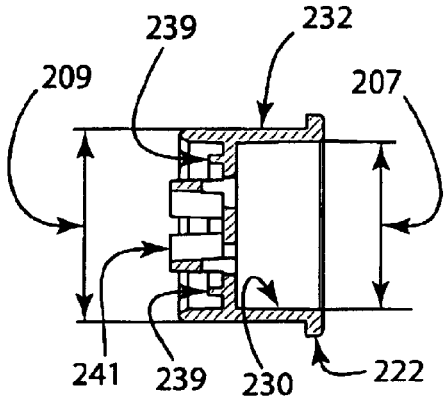
Figure 16-C
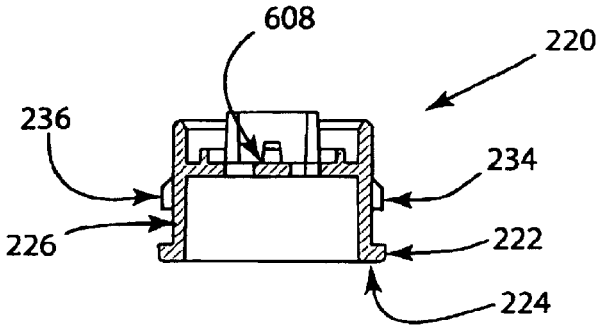
Figure 16-D
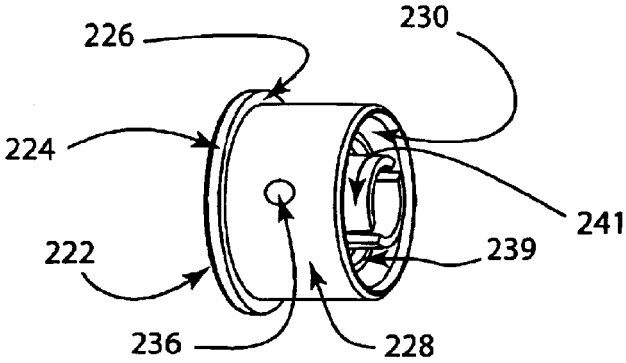
Figure 16-E

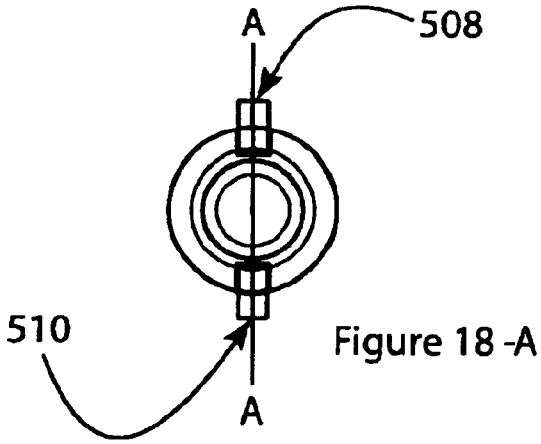
Figure 18 -A
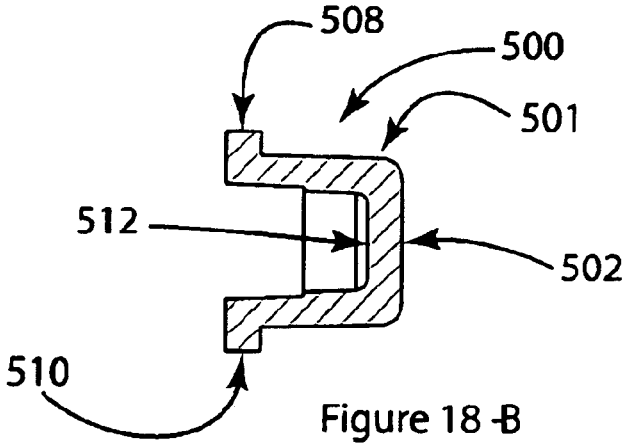
Figure 18 -B
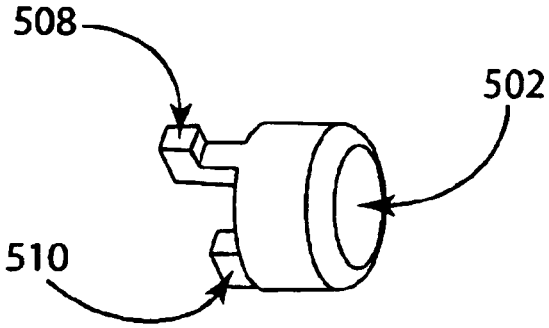
Figure 18 -C

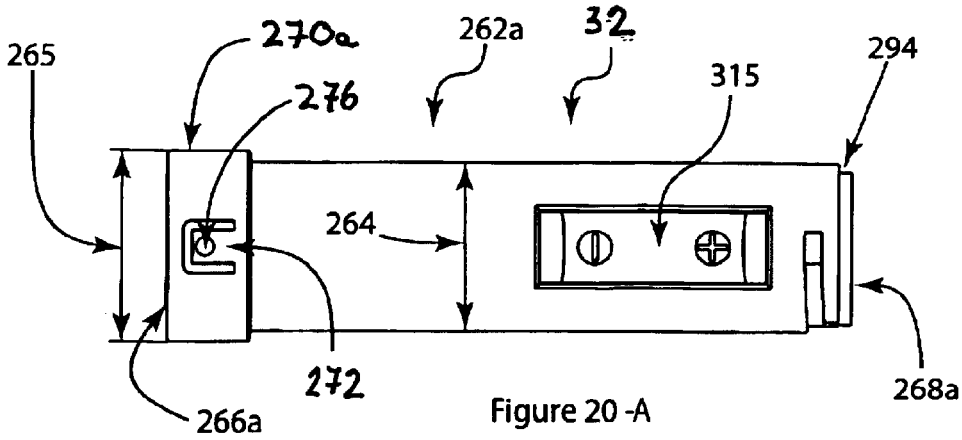
Figure 20 -A
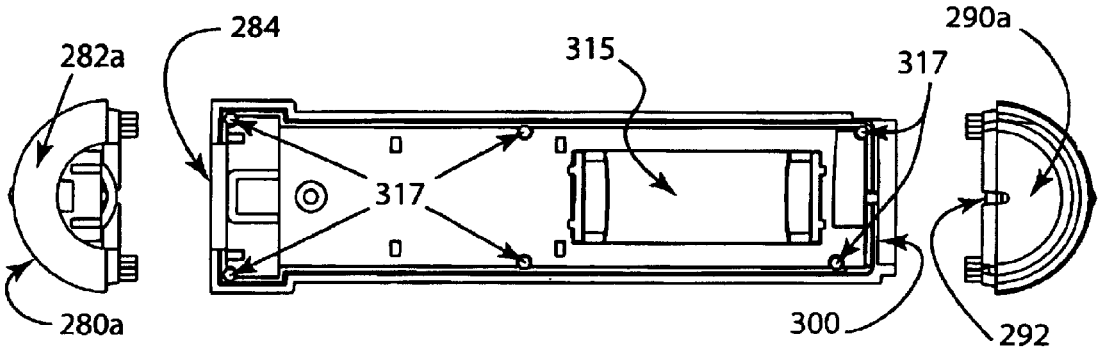
Figure 20 -D
Figure 20 -B
Figure 20 -E
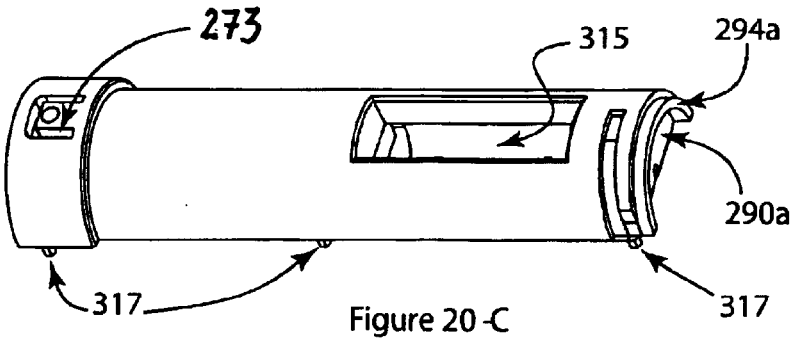
Figure 20 -C

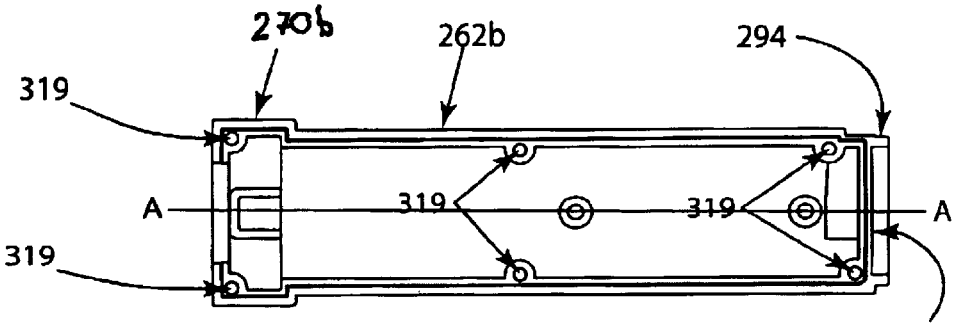
Figure 21-A
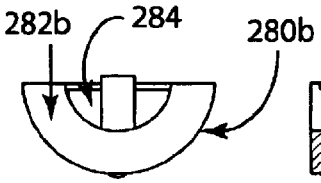
Figure 21-E
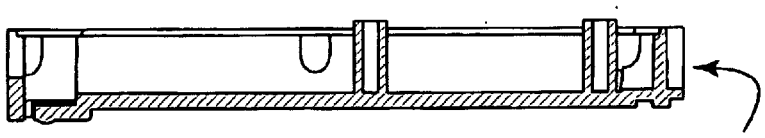
Figure 21-B
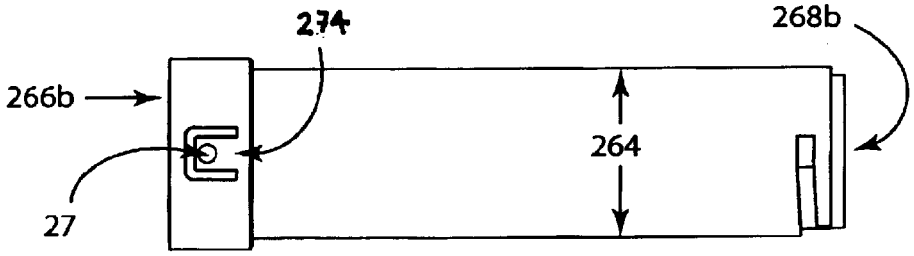
Figure 21-C
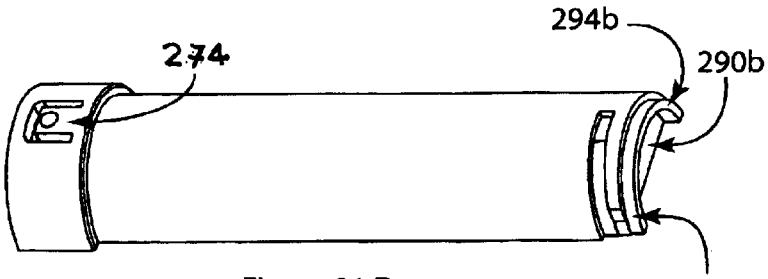
Figure 21-D

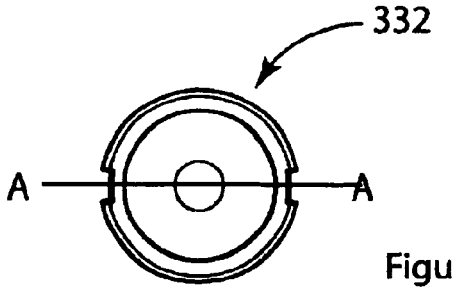
Figure 23 -A
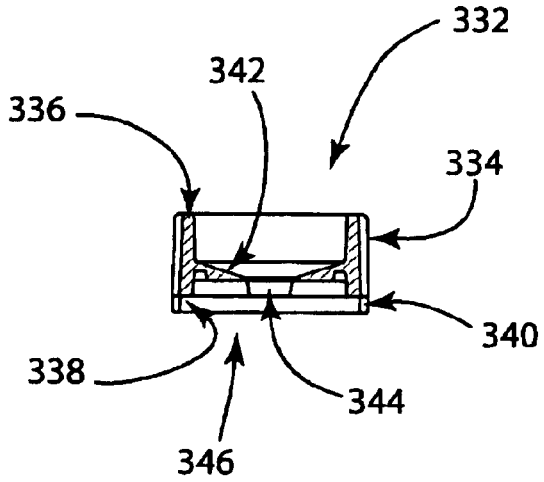
Figure 23 -B
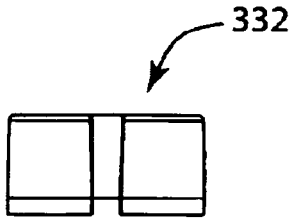
Figure 23 -C
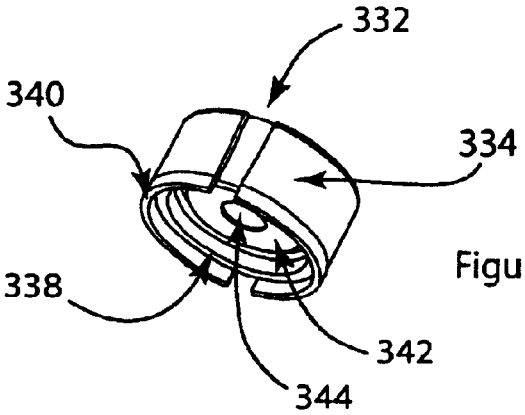
Figure 23 -D

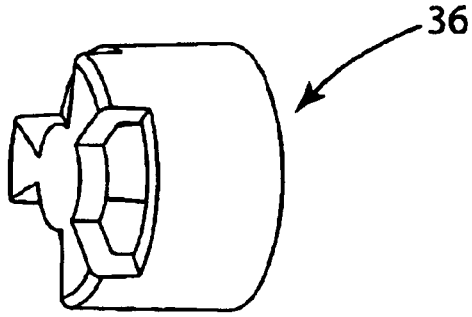
Figure 24-A
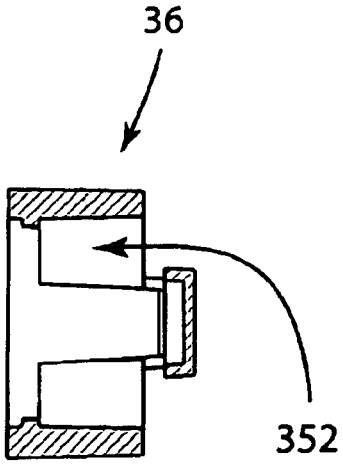
Figure 24-B
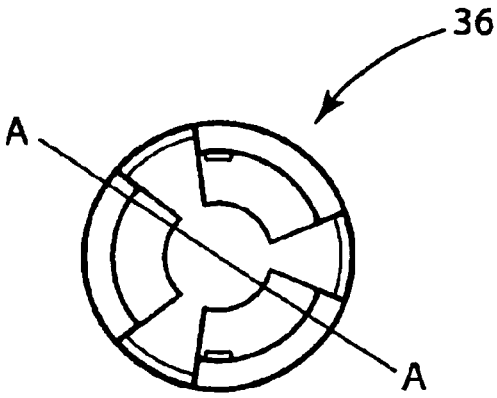
Figure 24-C

ADJUSTABLE ALARM DEVICE FOR SLIDING DOORS AND WINDOWS

CROSS REFERENCE TO RELATED APPLICATIONS

This application claims the benefit of U.S. Provisional Patent Application 60/336,173 filed on Dec. 6, 2001.

BACKGROUND

1. Field of the Invention

This invention relates to devices for intrusion detection through doors and windows and more specifically relates to an adjustable alarm device for sliding doors and windows.

2. Background of the Invention

Many homes and businesses are victimized by intruders that gain unauthorized access through doors and windows. There are several patents that disclose a variety of devices that provide for locks and alarms for sliding doors and windows. However, many of these devices are mechanically complex and therefore expensive to manufacture. For example, U. S. Pat. No. 6,388,572 "Selectively Positional Intruder Alarm for Sliding Windows and Doors" issued to Salter on May 14, 2002 discloses a portable device for sliding doors and windows. This device requires specially shaped ends to engage the tracks of a window sash that opens vertically. It is not suited to horizontally sliding doors and windows and so has a limited application in a house or business setting thereby reducing its usefulness and marketability. Therefore, this is a continued requirement for a simple, inexpensive and portable sliding window and door alarm that can be used in all sliding window and door applications.

OBJECTS OF THE INVENTION

It is an object of the present invention to provide a new and improved sliding door and window alarm.

It is a further object of the present invention to provide a new and improved sliding door and window alarm that is easy to operate, simple to manufacture and inexpensive to purchase.

SUMMARY OF THE INVENTION

The above noted objects and other objects of the invention are accomplished by the provision of an adjustable alarm device for windows and doors having an elongate tubular telescoping body. The body comprises an elongate outer first tube having a first end and a second end and an elongate inner second tube having a first end and a second end. The elongate inner second tube is slidingly received within the elongate outer first tube. The second end of the elongate inner second tube extends from the first end of the elongate outer first tube. Also provided are means for releasably locking the elongate inner second tube positionally with respect to the elongate outer first tube. Also included in the invention is an elongate outer third tube, having a first end and a second end. The elongate outer third tube is coupled to the second end of the elongate inner second tube by coupling means. There is also provided an elongate inner fourth tube having an outer surface. The elongate inner fourth tube is slidingly disposed within the elongate outer third tube. The elongate inner fourth tube extends from the second end of the elongate outer third tube. Also provided is an alarm circuit that is disposed within the elongate inner fourth tube and an alarm actuation means disposed within the coupling between the elongate outer third tube and the elongate inner fourth tube.

The elongate outer first tube of the invention has an inner surface, an outer surface, an inner diameter, an outer diameter, a longitudinal axis, a first end and a second end. The elongate outer first tube also has two apertures in the second end positioned opposite each other. The elongate inner second tube also has an inner surface, an outer surface, an inner diameter, an outer diameter, a longitudinal axis, two apertures in the first end positioned opposite each other and two apertures in the second end positioned opposite each other.

The alarm device further comprises a first end plug fixed to the first end of the elongate outer first tube. The first end plug is apertured to permit air flow therethrough so that when the elongate inner second tube is pushed into the elongate outer first tube, the air that is compressed within the elongate outer first tube is released through the aperture in the first end plug.

A first collar is slideably mounted within the second end of the elongate outer first tube. The first collar comprises a flange member having a top surface and a bottom surface. The top surface of the flange member is adapted for engagement with the outer edge of the second end of the elongate outer first tube. The bottom surface of the flange member is adapted for engagement with the first end of the elongate third outer tube. The collar further includes a neck member having an inner surface and an outer surface. The neck member depends upwardly from the flange and is slideably mounted within the second end of the elongate outer tube. The neck member has an inner diameter and an outer diameter. The outer diameter is dimensioned so that the outer surface of the neck member is in sliding frictional contact with the inner surface of the elongate outer first tube. The inner diameter is dimensioned so that the inner surface of the neck member is in frictional sliding contact with the outer surface of the elongate inner second tube.

The invention further includes means for fixing the first collar to the second end of the elongate outer first tube. The means comprises two depressible lugs positioned within the neck member. Each of the two depressible lugs is positioned radially opposite the other. The two depressible lugs have outward projecting pins integral thereto that are adapted for insertion into the two apertures in the second end of the elongate outer first tube. So, when the first collar is inserted into the second end of the elongated outer first tube the pins engage the apertures thereby fixing the first collar to the outer tube. Adhesive material is also applied between the outer surface of the first collar and the adjacent inner surface of the elongate outer first tube.

The invention also provides for a circular end cap fixed to the first end of the elongate second inner tube. The end cap has a base portion that has a smooth flat outer surface and an inner surface. The end cap also has a skirt portion. The first end of the elongate second inner tube is slideably received into the skirt portion of the cap to abut against the end cap inner surface. The circular end cap further includes a camshaft mounted to the outer surface of the end cap base portion. This camshaft includes a journal member having a longitudinal axis parallel to the longitudinal axis of the elongate second inner tube, a first end and a second end. The longitudinal axis of the cam shaft journal member is disposed off-centre from the longitudinal axis of the elongate second inner tube. One end of the journal member is fixed to the outer surface of the end cap base portion and the opposite end of the journal member is free. The journal also has two tabs radially mounted to the free second end. Each of the two tabs is mounted opposite to the other and project away from the axis of the journal. The tabs have a lower bearing surface and an upper surface.

Fixing the circular end cap to the first end of the elongate second inner tube is accomplished by providing a pair of apertures disposed opposite to each other in the skirt of the circular end cap. There is also a pair of corresponding apertures each of which apertures of the pair of apertures is disposed opposite each other in the first end of the elongate second inner tube. When the end cap is placed over the first end of the elongate second inner tube the apertures correspond. A pin member is then used to penetrate the apertures thereby pinning the circular cap to the first end of the elongate inner second tube. An adhesive material is placed between the inner surface of the skirt of the circular end cap and the adjacent outer surface of the first end of the elongate inner second tube.

In one embodiment of the invention there is provided means for releasably locking the elongate inner second tube positionally with respect to the elongate outer first tube. These means comprise a circular cam body mounted on to the camshaft journal. The cam body comprises a flat circular base member having smooth flat lower surface and an upper surface. The smooth flat lower surface is adapted for sliding rotational engagement with the smooth flat outer surface of the circular end cap. A skirt depends upwards from the outer circumference of the base. The skirt has a diameter equal to the diameter of the circular end cap and has a smooth outer surface. The smooth outer surface is adapted for entering into a releasably locking frictional engagement with the inner surface of the elongate outer first tube. There is a contact finger positioned within the skirt. The contact finger depends upwardly from the smooth flat upper surface of the circular cam body. The contact finger has a fixed end attached to the base member of the circular cam body and a free end. The free end of the finger terminates at the end of the skirt and has a protuberance projecting laterally outwards. The protuberance is urged laterally outward into contact with inner surface of the elongated outer first tube for frictional sliding contact. The cam body also includes a socket penetrating the flat circular base member of the cam body. The socket has a circumferential profile identical to the circumferential profile of the journal member and the two tabs. On the inside of the cam body, there are two partitioning members raised vertically from the upper surface of the flat circular base member. These two partitioning members each have an upper edge and each transverse the upper surface of the flat circular base member. Each of the two partitioning members is positioned face to face across the socket and the profile of each of the two partitioning members follows the profile of the socket so that when the socket of the cam body is received by the journal and the two tabs mounted radially thereto, and rotated thereon, the smooth flat lower surface of the flat circular base member of the cam body is in rotational sliding contact with the smooth flat outer surface of the circular end cap, and the lower bearing surfaces of the two radially mounted tabs are in sliding contact with the upper edges of the two partitioning members.

The cam body has a first unlocked position with respect to the inner surface of the elongate outer first tube and a second locked position with respect to the inner surface of the elongate outer first tube. In the first unlocked position, the cam body skirt is disengaged from the inner surface of the elongate outer first tube and the laterally projected protuberance is in fictional contact with the inner surface of the elongate outer first tube thereby permitting controlled sliding movement between the elongate outer first tube and the elongate inner second tube. In the second releasably locked position, the cam body skirt is in tight frictional engagement with the inner surface of the elongate outer first tube thereby prohibiting any relative movement between the elongate outer first tube and the elongate inner second tube. The cam body is moved from an unlocked position to releasably locked position by twisting the elongate outer first tube and the elongate inner second tube in opposite directions thereby causing the cam body to rotate on the journal which in turn causes the cam body skirt to frictionally engage the inner surface of the elongated first outer tube. The cam body is moved from a releasably locked position to an unlocked position by twisting the elongate outer first tube and the elongate inner second tube in directions opposite to the directions taken to lock the cam body.

The elongate outer third tube has an inner surface, an outer surface, an inner diameter, an outer diameter, a longitudinal axis, a first end and a second end. The elongate outer third tube has an inner diameter equal to the inner diameter of the elongate outer first tube and an outer diameter equal to the outer diameter of the elongate outer first tube. The first end of the elongate outer third tube includes two apertures positioned opposite each other. The elongate outer third tube further includes a plurality of ribs spaced radially about the second end of the elongate outer third tube. These ribs extend longitudinally from the second end of the elongate outer third tube towards the first end of the elongate outer third tube. In profile, the ribs have an elevation from the inner surface of the elongate outer third tube sufficient to frictionally engage the outer surface of the elongate inner fourth tube thereby facilitating controlled movement of the elongate inner fourth tube relative to the elongate outer third tube.

Coupling means is provided to couple the elongate outer third tube to the elongate inner second tube. Coupling means comprise a second collar having a flange member. The flange member has a top surface and a bottom surface. The bottom surface is adapted for engagement with the outer edge of the first end of the elongate outer third tube. The top surface of the flange is adapted for engagement with the top surface of the first collar. The second collar includes a neck member that has an inner surface and an outer surface. The neck member depends upwards from the flange and is slideably mounted within the first end of the elongate outer third tube. The neck member has an inner diameter and an outer diameter. The outer diameter is dimensioned so that the outer surface of the neck member is in sliding frictional contact with the inner surface of the elongate outer third tube. Also include in the neck member are two pins depending radially from the neck member. Each of the two pins is disposed opposite the other. Each of the pins is adapted for insertion into the two apertures in the first end of the elongate outer third tube. So, when the third tube is inserted over the neck of the collar the two pins will engage the two apertures thereby fixing the collar to the elongate outer third tube. An adhesive material is applied between the outer surface of the neck member and the inner surface of the first end of the elongate outer third tube.

The second collar also comprises a first mount for mounting biasing means for biasing the alarm device against a window and a second mount for mounting alarm actuation means.

The elongate inner fourth tube comprises a housing having an outer diameter. The housing is adapted to contain a plurality of components comprising the alarm circuit. The housing further comprises a first end and a second end. The first end has a collar having an outer diameter greater than the outer diameter of the housing and less than the inner diameter of the elongate third outer tube. The collar has two biased lugs each having an embossment urged radially outwardly to engage in frictional contact with the inner surface of the elongate outer third tube permitting controlled axial sliding telescoping movement of the housing relative to the elongate third outer tube. The first end of the housing is partially enclosed by a ring having a bearing surface and adapted to bear against the biasing means for biasing the alarm against a door and window. The ring has a central hole permitting the alarm actuating device to engage the normally open switch of the alarm circuit. The second end of the housing is enclosed by a disc having an aperture in its centre. The second end of the housing further includes a ring depending upwards from the end of the second housing. The ring has an upper surface and the ring and the disc together form a hollow portion in the second end of the housing. In one embodiment of the invention the housing is a split into two symmetrical halves joined together.

The alarm device of my invention includes an alarm circuit mounted within the elongate inner fourth tube comprising a battery, a control circuit, a noise generator in the form of an audio-transducer and a normally open switch between the battery and the noise generator. In one embodiment of the invention the control circuit is mounted on to a printed circuit board. In another embodiment of the invention, the control circuit mounts a timer. The timer operates to restrict the amount of time that the noise generator will operate upon actuation to prevent depletion of the battery. In another embodiment of the invention the control circuit includes a transformer to transform battery voltage to a voltage suitable for the noise generator. The audio transducer is mounted on the upper surface of the ring and over the hollow thereby forming a resonating sound chamber beneath the audio transducer that has the effect of mechanically amplifying the sound. The alarm circuit further comprises a sound amplification body mounted over the audio transducer. The body comprises a cylindrical ring having a top edge and a bottom edge and a flange depending downwards from the bottom edge of the cylindrical ring. The flange is adapted to fit over and enclose the ring at the second end of the housing. The amplification body further includes a plano-concave disc disposed within the cylindrical ring. The disc has an aperture in its centre and the plane side of the disc is positioned above and in operative relation to the audio-transducer so that the audio-transducer, the amplification body and the resonating chamber act together to produce an amplified alarm sound.

An end cap is mounted over the amplification body. The end cap is fixed to the second end of the elongate inner fourth tube and has an outer diameter equal to the outer diameter of the elongate outer third tube. The end cap has a plurality of openings permitting sound to be transmitted.

In another embodiment of the invention there is provided a solar charger that is operatively connected to the alarm circuit to permit recharging of the battery. The solar charger comprises a plurality of photovoltaic cells suitably dimensioned to fit onto the body of the alarm device in such manner that they may be exposed to a light source while installed in a window or door frame. The solar charger further comprises means for regulating the power received from the photovoltaic cells to prevent overcharging of the battery.

In yet another embodiment of the invention there is provided a glass break alarm comprising a sound receiving device that is sympathetic to the sound of breaking glass of various types. The sound receiver is operatively connected to a memory means within the alarm circuit. A comparator compares the sound received with the sounds stored on the memory means to determine if the sound is the breakage of glass. If the breaking glass is identified then the alarm is actuated.

In a further embodiment of the invention there is provided means for detecting vibrations that might be caused by tampering with the alarm device once installed. If vibrations are detected then the alarm is actuated.

In still a further embodiment of the invention there is provided means for the detection of movement of warm bodies. For example, infra-red motion detectors may be installed on the alarm device capable of detecting the motion of persons in the proximity of the device.

In yet another embodiment of the invention, the alarm circuit is remotely connected to an alarm circuit monitoring system. In this embodiment, when the alarm circuit is triggered the alarm will sound and a signal will be remotely transmitted to a monitoring station. Authorized personnel at the monitoring station can then respond to the alarm. In another embodiment, the alarm on the alarm device may have a sound mode and a silent mode so that in the silent mode the actuated alarm will remotely transmit a signal to the remote monitoring station in a silent fashion.

In operation, the alarm device is adjusted so that the end cap of the device abuts the frame of a sliding window or door and the end cap of the elongated outer first tube abuts the opposite frame so that if the sliding door or window is moved in an open direction the device is in compression. The device is locked into position by twisting the elongate inner second tube within the elongate outer first tube. In this way, the cam body is moved from its first operating position to its second releasably locked engagement. The surface of the skirt of the cam body is frictionally engaged with the inner wall of the elongate outer first tube. The elongate inner fourth tube is biased against the biasing means and capable of sliding movement with respect to the elongate outer third tube. When the end cap is engaged with the door or window frame, the biasing means within the second collar biases the end cap against the door or window frame. In this configuration, there is a gap between the alarm actuation means and the normally open switch in the alarm circuit. If the door or window is moved in the direction of the alarm device, for example by an intruder attempting to open the sliding window or door, the end cap, attached to the elongate inner fourth tube, is depressed and the actuation means engages and closes the normally open alarm switch thereby activating the alarm.

Still further objects and advantages of the invention will become apparent from a consideration of the ensuring description and drawings.

BRIEF DESCRIPTION OF THE DRAWINGS

The invention will be more readily understood by reference to the following description, taken with the accompanying drawings, in which:

FIGS. 4A–B, are a side view and top view of the elongate outer first tube of one embodiment of the invention.

FIGS. 5A–C, are various views of the elongate inner second tube of one embodiment of the invention.

FIGS. 7A–B, are various views of the elongate outer first tube end cap of one embodiment of the invention.

FIGS. 8A–C, are various views of the elongate outer first tube first collar of one embodiment of the invention.

FIGS. 9A–D, are various views of the elongate outer first tube first collar of one embodiment of the invention.

FIGS. 10A–F, comprises various views of the end cap of the elongate inner second tube of one embodiment of the invention.

FIGS. 11A–F, comprise various views of the end cap of the elongate inner second tube of one embodiment of the invention.

FIGS. 12A–F, comprises various views of the cam body of one embodiment of the invention.

FIG. 13A, is a perspective end view of the skirt of the cam body disengaged from the inner wall of the elongate first outer tube.

FIGS. 15A–D, comprises various views of the elongate outer third tube of one embodiment of the invention.

FIGS. 16A–E, comprises various views of the second collar of one embodiment of the invention.

FIGS. 18A–C, comprises various views of the actuator means.

FIGS. 20A–E, comprises various views a first half body of the elongate inner fourth tube of one embodiment of the invention.

FIGS. 21A–E, comprises various views of a second half body of the elongate inner fourth tube of one embodiment of the invention.

FIGS. 23A–D, comprises various views of the amplifier cap of one embodiment of the invention.

FIGS. 24A–C, comprises various views of the end cap of one embodiment of the present invention.

DETAILED DESCRIPTION

Figure 1:
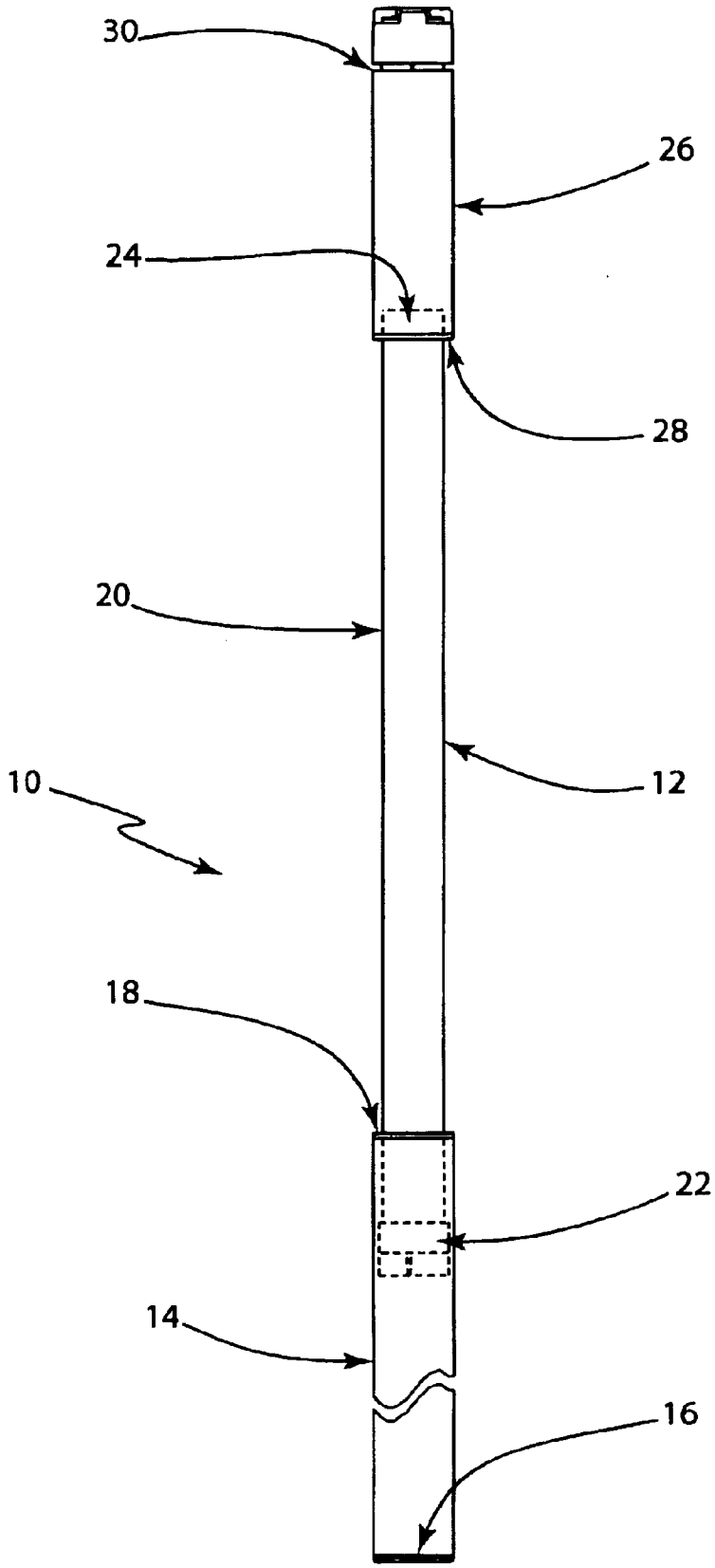
FIG. 1 is a side view of one embodiment of the invention in an extended configuration.

Referring to FIG. 1, there is shown a preferred embodiment of the invention. An adjustable alarm device for windows and doors is shown generally as (10). The alarm device has an elongate tubular telescoping body shown generally as (12) comprising an elongate outer first tube (14) having a first end (16) and a second end (18). In FIG. 1, the elongate outer first tube (14) is depicted in a truncated fashion for illustration purposes only. The alarm device further comprises an elongate inner second tube (20) having a first end (22) and a second end (24). The elongate inner second tube (20) is slidingly received within the elongate outer first tube (14). The second end (24) of the elongate inner second tube (20) extends from the first end (18) of the elongate outer first tube (14).

The invention (10) also includes means for releasably locking the elongate inner second tube (20) positionally with respect to the elongate outer first tube (14). For example, as depicted in FIG. 1, the relative position of the sliding elongate inner second tube (20) with respect to the stationary elongate outer first tube (14) can be releaseably locked by releasable locking means. This is described more fully below and in subsequent figures.

The invention (10) also comprises an elongate outer third tube (26), having a first end (28) and a second end (30). The elongate outer third tube (26) is coupled to the second end (24) of the elongate inner second tube (20) by coupling means which are more fully described below and in subsequent figures.

Figure 2:
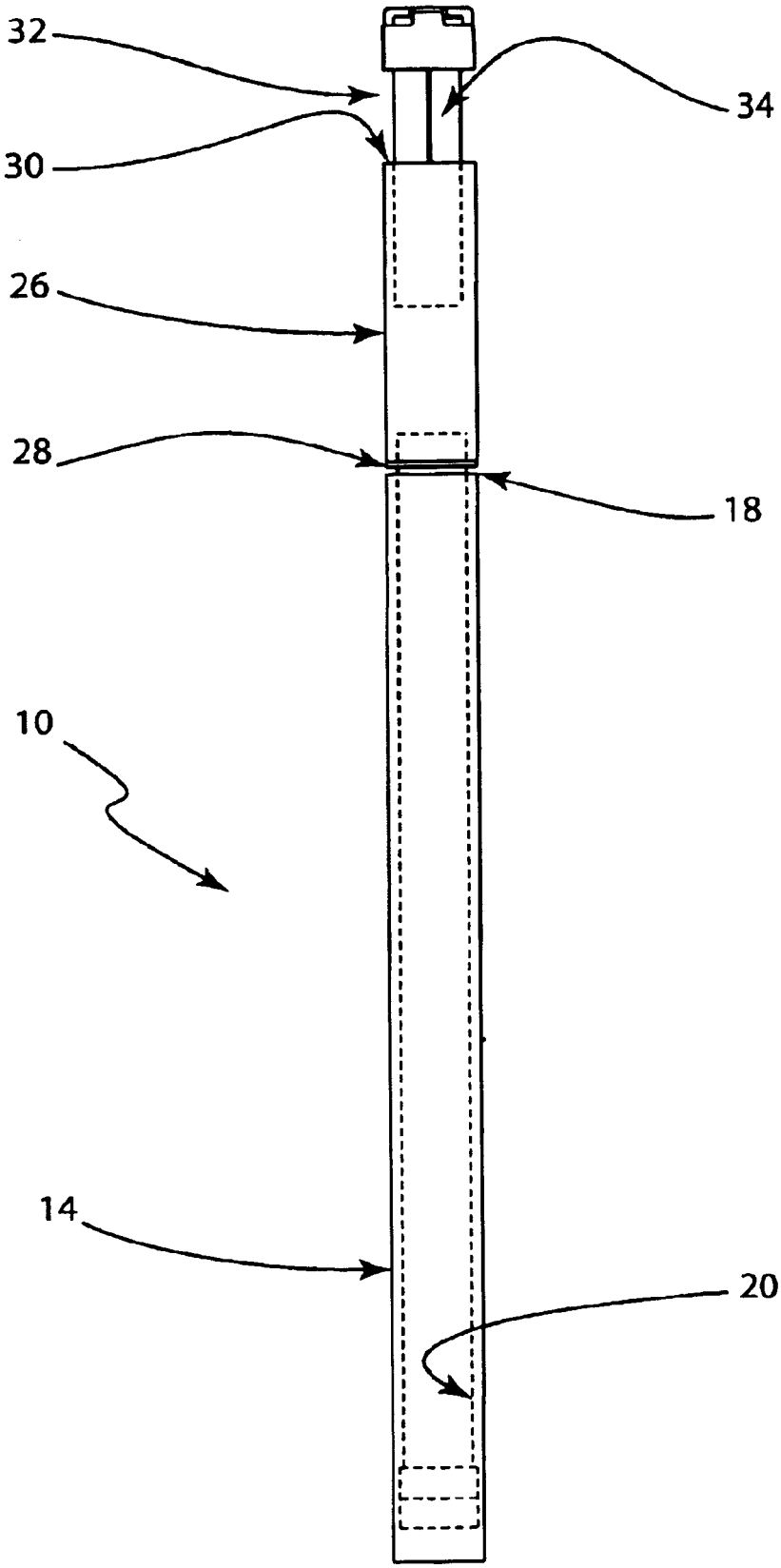
FIG. 2 is a side view of one embodiment of the invention in partially collapsed configuration.

Referring now to FIG. 2, there is shown the same embodiment of my invention (10) as shown in FIG. 1. However, in FIG. 2, the elongate inner second tube (20) has been telescoped into the elongate outer first tube (14). The elongate outer third tube (26) first end (28) abuts against the elongate outer first tube (14) second end (18). In FIG. 2, additional detail is shown in the form of the elongate inner fourth tube (32) having an outer surface (34). As seen from FIG. 2, the elongate inner fourth tube (32) is slidingly disposed within the elongate outer third tube (26). The elongate inner fourth tube (32) extends from the second end (30) of the elongate outer third tube (26).

Figure 3:
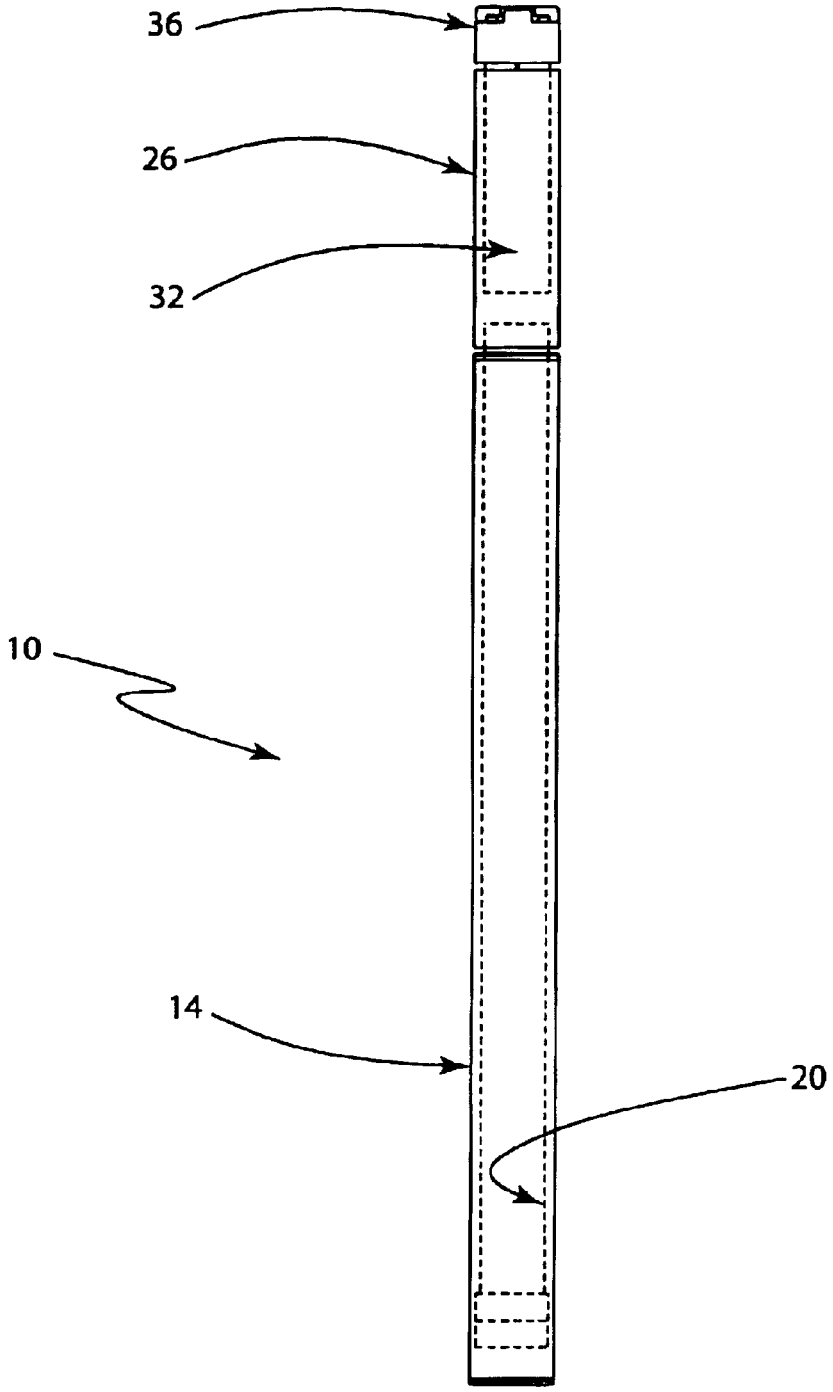
FIG. 3, is a side view of one embodiment of the invention in a fully collapsed configuration.

Referring now to FIG. 3, there is shown the same embodiment of my invention (10) as shown in FIGS. 1 and 2. In FIG. 3, my invention (10) is illustrated in a fully collapsed configuration. In this configuration, elongated inner second tube (20) is telescoped within elongated outer first tube (14). Elongated inner fourth tube (32) is telescoped within elongated outer third tube (26). Also illustrated in FIG. 3, is end cap (36) more fully discussed below.

Referring now to FIGS. 4A–B, there is shown a side view of the elongate outer first tube (14) of my invention and a top view respectively. The outer first tube has an inner surface (48), an outer surface (50), an inner diameter (52), an outer diameter (54), a longitudinal axis (58), a first end (16) and a second end (18). The elongate outer first tube (14) further includes two apertures (60) and (62) in the second end (18). The two apertures are positioned opposite to each other.

Referring now to FIGS. 5A–C, there is shown the elongate inner second tube (20). A side view of the tube is shown in FIG. 5-A. A view of the tube second end is shown in FIG. 5-B and a view of the tube first end is shown in FIG. 5-C. The elongate inner second tube (20) further has an inner surface (64), an outer surface (66), an inner diameter (68), an outer diameter (70), a longitudinal axis (72), two apertures (74) and (76) in first end (22) positioned opposite each other and two apertures (78) and (80) in second end (24) positioned opposite each other.

Figure 6:
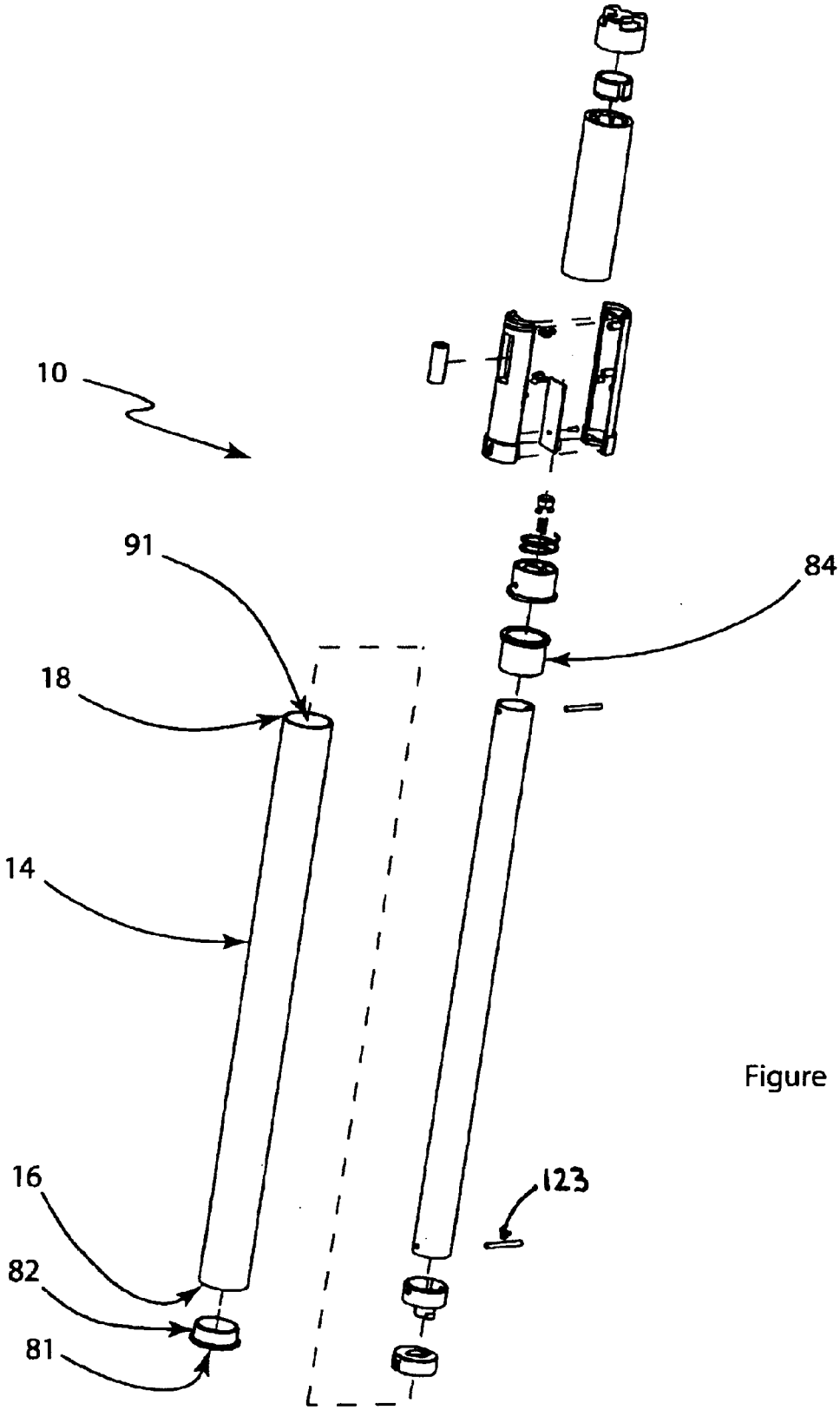
FIG. 6, is an assembly diagram for one embodiment of the invention.

Referring now to FIG. 6, there is shown an assembly view of my invention (10). The first end (16) of the elongate outer first tube (14) is capped with a first end plug (82). The first end plug is apertured (81) to permit air flow therethrough. First collar (84) is slideably mounted within second end (18) of the elongate outer first tube (14). The outer edge of the second end (18) is shown as item (91).

Referring now to FIGS. 7A–B, there is shown an oblique side view of the elongate outer first tube end cap (82) and a sectional side view of the end cap respectively. The end cap comprises a base member (85), a neck member (89) and a flange member (87). The neck member (89) is adapted to frictionally fit within the first end (16) of the elongate outer first tube (14) so that the edge of end (16) abuts against the flange (87). The neck member (89) is fixed in place by adhesive material placed between the outer surface of the neck member and the adjacent inner surface of the elongate outer first tube. The end cap is apertured at (81) to permit air flow.

Referring now to FIGS. 8A–C, there is shown a sectional side view, a side view and an oblique side view respectively of first collar (84) comprising a flange member (86) having a bottom surface (88) and a top surface (90). The surface (90) of the flange (86) is adapted for engagement with the outer edge (91) of the second end (18) of the elongate outer first tube (14). The surface (88) of the flange (86) is adapted for abutting engagement with the first end (28) of the elongate third outer tube (26). The collar (84) further includes a neck (92). The neck has an inner surface (94) and an outer surface (96). The neck (92) depends upwardly from the flange (86) and is slideably mounted within the second end (18) of the elongate outer first tube (14). The neck has an inner diameter (98) and an outer diameter (100). The outer diameter (100) is dimensioned so that the outer surface (96) of the neck (92) is in sliding frictional contact with the inner surface (48) of the elongate outer first tube (14). The inner diameter (98) of the neck is dimensioned so that the inner surface of the neck (94) is in frictional sliding contact with the outer surface (66) of the elongate inner second tube (20).

Referring now to FIGS. 9A–D, there is shown a top view, a sectional side view, a side view and an oblique side view of the first collar (84). The first collar (84) further comprises means for fixing the first collar (84) to the second end (18) of the elongate outer first tube (14). Means for fixing comprises two depressible lugs (102) and (104) positioned within the neck (92). Each of the two depressible lugs is positioned radially opposite the other. Each of the two depressible lugs has outward integral projecting pins (106) and (108). The pins are adapted for insertion into the two apertures (60) and (62) in the second end (18) of the elongate outer first tube (14). So when the first collar (84) is inserted into the second end (18) of the elongated outer first tube (14) the pins (106) and (108) engage the apertures (60) and (62) thereby fixing the first collar to the outer tube. Adhesive material is also applied between the outer surface of the first collar and the adjacent inner surface of the elongate outer first tube.

Referring now to FIGS. 10A–F, the alarm device of my invention further comprises a circular end cap (110) fixed to the first end (22) of the elongate second inner tube (20). FIG. 10A is a top view of the end cap. FIG. 10-B is a sectional side view along line A—A. FIG. 10-C is a sectional side view along line B—B. FIG. 10-D is a bottom view of the end cap. FIG. 10-E is a sectional side view along line C—C and FIG. 10-F is an oblique side view of the end cap. The end cap (110) has a base portion (12) having a smooth flat outer surface (114) and an inner surface (116). The end cap also comprises a skirt portion (118). The first end (22) of the elongate inner second tube (20) is slideably received into the skirt portion (118) of the end cap (110) to abut against the end cap inner surface (116). The end cap (110) includes apertures (120) and (122). When the first end (22) of the elongate inner second tube (20) abuts against the end cap inner surface (116) apertures (I120) and (122) are aligned with apertures (74) and (76) in the first end (22) of the elongate inner second tube (20). A pin (123) is inserted through the aligned apertures (122, 74, 120 and 76) to pin the end cap (110) to the first end (22) of the elongate inner second tube (20). Adhesive material is also added between the inner surface (130) of the end cap (110) and the adjacent outer surface (66) of the elongate inner second tube (20).

Referring now to FIGS. 11A–F, there is shown identical views of the same embodiment of the end cap (110) as shown in FIG. 10. The circular end cap (110) further comprises a camshaft (132) mounted to the outer surface (114) of the end cap base portion (112). The camshaft (132) includes a journal member (134) having a longitudinal axis (135) parallel to the longitudinal axis (72) of the elongate second inner tube (20), a first end (138) and a second end (140). The longitudinal axis (135) of the journal member (134) is disposed off-centre from the longitudinal axis (72) of the elongate second inner tube (20). The second end (140) of the journal member (134) is fixed to the outer surface (114) of the end cap base portion (112). The first end (138) of the journal member (134) is free. The journal member (134) further includes two tabs (142) and (144) radially mounted to the free end (138) of the journal member. Each of the two tabs (142) and (144) are mounted opposite to the other and project away from the axis (135) of the journal member. Tab (144) has a lower bearing surface (146*a*) and an upper bearing surface (148*a*). Tab (142) has a lower bearing surface (146*b*) and an upper surface (148*b*).

Referring now to FIGS. 12A–F, the means for releasably locking the elongate inner second tube (20) positionally with respect to the elongate outer first tube (14) comprises a circular cam body (150) mounted on to the camshaft journal member (134). FIG. 12-A shows a top view of the cam body. FIG. 12-B shows a sectional side view of the cam body along line A—A. FIG. 12-C shows a right hand side view of the cam body. FIG. 12-D shows a bottom view of the cam body. FIG. 12-E shows an oblique top view of the cam body and FIG. 12-F shows an oblique bottom view of the cam body. The cam body (150) comprises a flat circular base member (152) having smooth flat lower surface (154) and an upper surface (156). The smooth flat lower surface (154) of the cam body (150) is adapted for sliding rotational engagement with the smooth flat outer surface (114) of the circular end cap (110). Skirt (158) depends upwardly from the outer circumference of the base (152). The skirt (158) has an outer diameter equal to the outer diameter of the circular end cap (110) and a smooth outer surface (160). The smooth outer surface (160) is adapted for entering into a releasably locking frictional engagement with the inner surface (48) of the elongate outer first tube (14). Contact finger (162) is positioned within the skirt (158). The contact finger depends upwards from the base (152). The contact finger (162) has a fixed end (164) attached to the base (152) of the circular cam body (150) and a free end (165). The free end terminates at the end of the skirt and has a protuberance (166) projecting laterally outwards therefrom. When the cam body is inserted into the elongate outer first tube (14) the protuberance (166) is urged laterally outward and into contact with inner surface (48) of the elongated outer first tube (14) for frictional sliding contact therewith. The cam body (150) also includes a socket (168) penetrating the flat circular base (152) of the cam body. The socket has a circumferential profile identical to the circumferential profile of the journal member (134) and the two tabs (142) and (144) radially mounted thereto.

Figure 13:
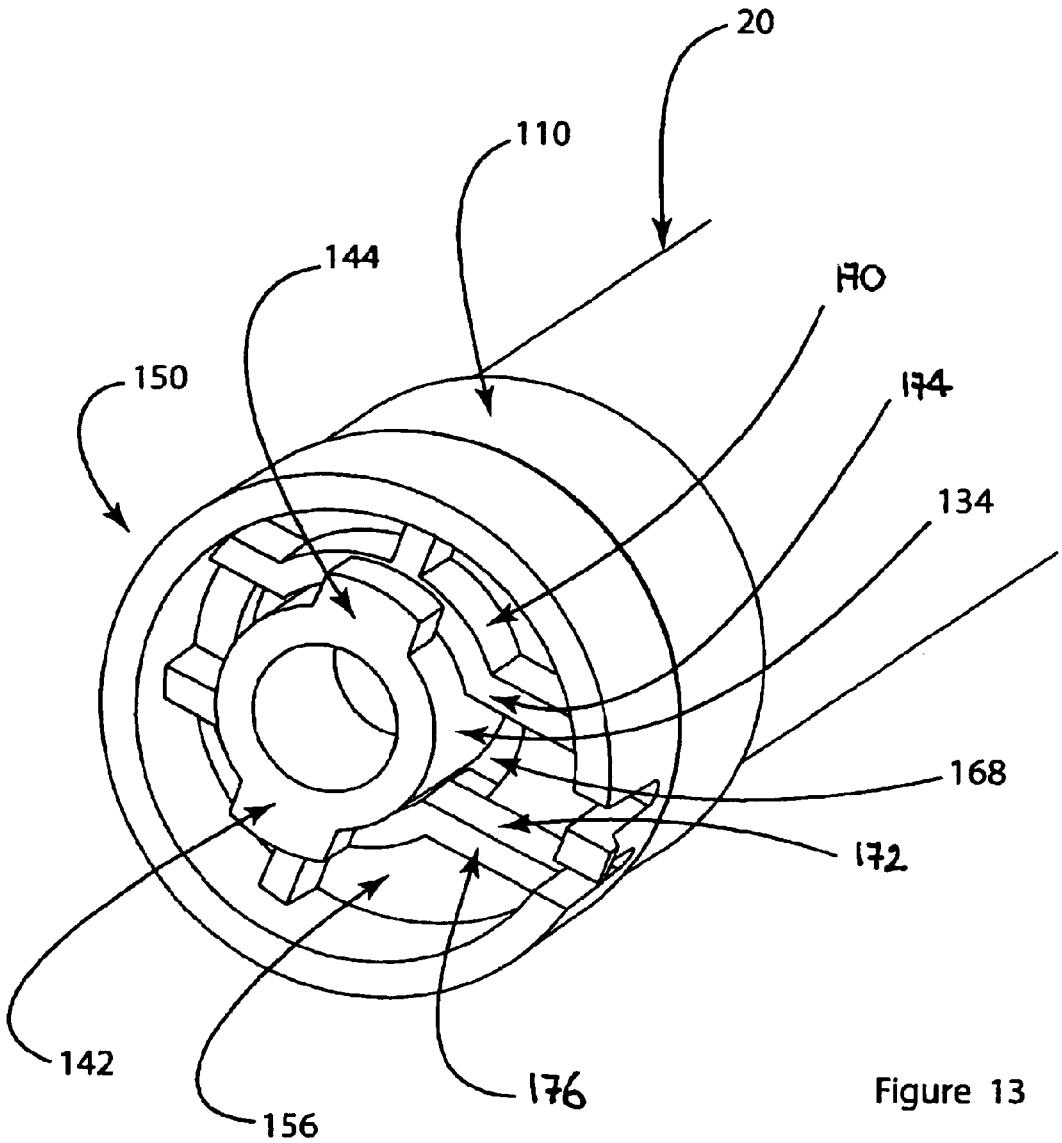
FIG. 13, is a perspective end view of the cam body of one embodiment of the invention showing the cam body mounted to the end cap of the elongate inner second tube.

Referring now to FIG. 13, there is shown the cam body (150), the end cap (110) and the elongate inner second tube (20). The cam body (150) is mounted onto the journal member (134) through socket (168). The flat lower surface (154) (FIG. 12) of the cam body (150) is in sliding contact with the flat smooth surface (114) (FIG. 11) of the end cap (110). Details of the inner surface (156) of the cam body base member (152) are shown. Two partitioning members (170) and (172) are raised vertically from the inner surface (156) of the base member (152) of the cam body (150). The two partitioning members each have an upper edge (174) and (176) and each traverse surface (156). Each of the two partitioning members is positioned face to face across the socket (168) and the profile of each of the two partitioning members follows the profile of the socket. When the socket (168) of the cam body (150) is received by the journal (134) and the two tabs (142) and (144) mounted radially thereto are rotated, the smooth flat lower surface of the flat circular base member of the cam body is in rotational sliding contact with the smooth flat outer surface of the circular end cap. The lower bearing surfaces **(146*a*) and (146*b*) (FIG. 11) of the, two radially mounted tabs (142) and (144) are in sliding contact with the upper edges (174) and (176) of the two partitioning members. As illustrated in FIG. 13, the tabs (142) and (144), the members (170) and (172), and the socket (168)** act cooperatively to retain the cam body on the journal in a rotationally sliding engagement.

Referring now to FIG. 13A, the cam body (150) has a first unlocked position with respect to the inner surface (48) of the elongate outer first tube (14). In the first unlocked position, the cam body skirt (158) is disengaged from the inner surface (48) of the elongate outer first tube (14). The outer surface of the skirt of the cam body and the outer surface of the skirt (118) of the end cap (110) are generally flush with each other. The laterally projected protuberance (166) on the contact finger (162) is in frictional contact with the inner surface (48) of the elongate outer first tube (14). This permits controlled sliding movement between the elongate outer first tube (14) and the elongate inner second tube (20).

Figure 14:
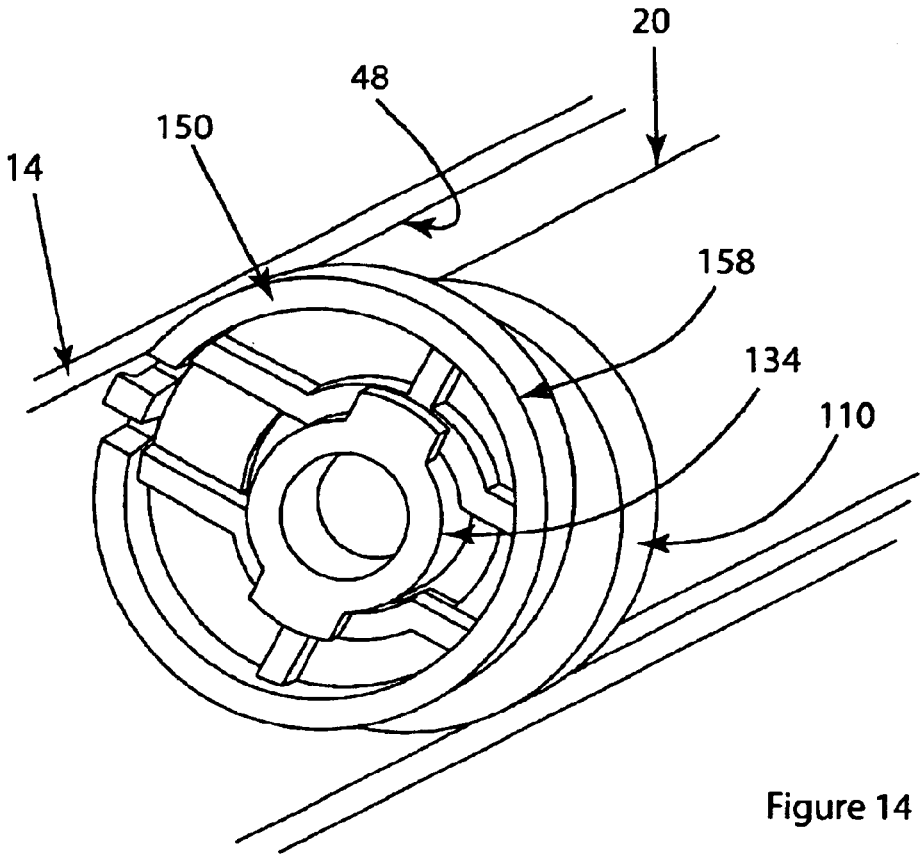
FIG. 14, is a perspective end view of the cam body of one embodiment of the invention showing the cam body in a releasably locked position and the skirt frictionally engaged with the inner surface of the elongate outer first tube.

Referring now to FIG. 14, the cam body (150) is shown in a second releasably locked position with respect to the end cap (110). The cam body (150) has been rotated on journal (134) so that the cam body skirt (158) is in tight frictional engagement with the inner surface (48) of the elongate outer first tube (14) thereby prohibiting any relative movement between the elongate outer first tube (14) and the elongate inner second tube (20). The cam body (150) is moved from a unlocked position to releasably locked position by twisting the elongate outer first tube (14) and the elongate inner second tube (20) in opposite directions thereby causing the cam body (150) to rotate on the journal member (134) which in turn causes the cam body skirt (158) to frictionally engage the inner surface (48) of the elongated first outer (14) tube. The cam body is moved from a releasably locked position to an unlocked position by twisting the elongate outer first tube and the elongate inner second tube in directions opposite to the directions taken to lock the cam body.

Referring now to FIGS. 15A–D, there is illustrated various views of the elongate outer third tube (26) having a first inner surface (192), a second inner surface (195), an outer surface (194), an inner diameter (196), an outer diameter (198), a longitudinal axis (200), a first end (28) and a second end (30). FIG. 15-A illustrates a side view of the outer third tube. FIG. 15-B illustrates a cross-sectional side view of the outer third tube. FIG. 15-C illustrates a first end view of the outer third tube. FIG. 15-D illustrates an oblique side view of the outer third tube. The elongate outer third tube has an inner diameter equal to the inner diameter of the elongate outer first tube and an outer diameter equal to the outer diameter of the elongate outer first tube. The first end (28) of the elongate outer third tube includes includes two apertures (206) and (208) positioned opposite each other. The elongate outer third tube (26) further includes a plurality of ribs (210) spaced radially about the second end (30) of the elongate outer third tube. The ribs extend longitudinally from the second end (30) towards the first end (28). The ribs have an elevation from the first inner surface (192) of the elongate outer third tube sufficient to frictionally engage the outer surface of the elongate inner fourth tube (described below) thereby facilitating controlled movement of the elongate inner fourth tube relative to the elongate outer third tube.

Referring now to FIGS. 16A–E, the coupling means connecting the second end (24) of elongate inner second tube (20) with the first end (28) of the elongate outer third tube (26) comprises a second collar (220) comprising a flange member (222) having a bottom surface (224) and a top surface (226). FIG. 16-A shows a top view of the coupling means. FIG. 16-B shows a side view of the coupling means. FIG. 16-C shows a sectional side view of the coupling means along line B—B. FIG. 16-D shows a sectional side view of the coupling means along line A—A and FIG. 16-E shows an oblique side view of the coupling means. The surface (226) is adapted for engagement with the outer edge (202) (illustrated in FIG. 15-B) of the first end (28) of the elongate outer third tube (26). The surface (224) is adapted for abutting engagement with the top surface (88) (illustrated in FIG. 8-A) of the first collar (84). The second collar (220) includes a neck (228) having an inner surface (230) and an outer surface (232). The neck depends upwardly from the flange and is slideably mounted within the first end (28) of the elongate outer third tube (26). The neck has an inner diameter (207) and an outer diameter (209). The outer diameter is dimensioned so that the outer surface of the neck is in sliding frictional contact with the second inner surface (195) (illustrated in FIG. 15-B) of the elongate outer third tube (26). Two pins (234) and (236) depend radially from the neck (228) each of the two pins is disposed opposite the other. The pins are adapted for insertion into the two apertures (206) and (208) in the first end (28) of the elongate outer third tube (26) so when the third tube is inserted over the neck of the collar the two pins will engage the two apertures (206) and (208) thereby fixing the collar to the outer tube. Adhesive material is applied between the outer surface of the neck and the adjacent inner surface of the first end of the elongate outer third tube. The second collar (220) further comprises a first mount (239) for a first biasing means (400) for biasing the alarm device against a window and a second mount (241) for alarm actuation means (500) more fully described below.

Figure 17A:
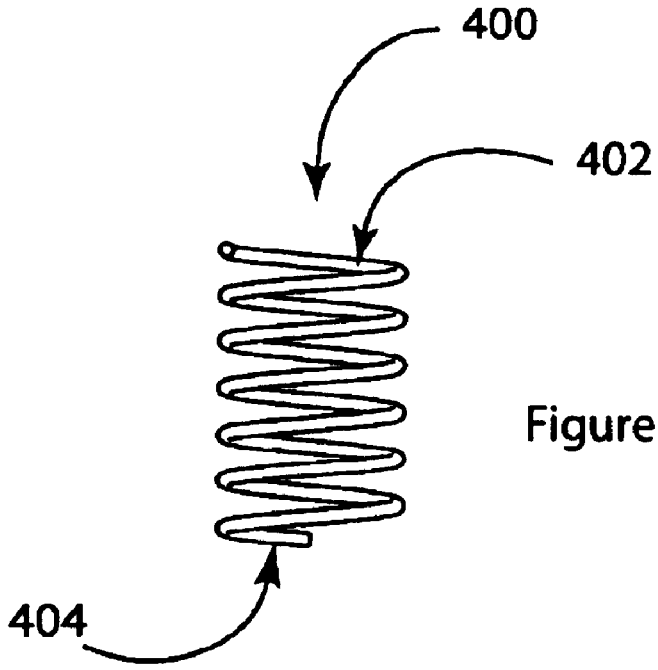
FIGS. 17A–B, comprises various views of the biasing means comprising a spring.
Figure 17B:
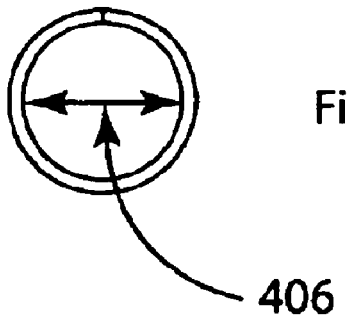

Referring now to FIGS. 17A–B, first biasing means (400) comprises a spring having a first end (402), a second end (404) and a circumference (406). FIG. 17A shows a side view of the spring and FIG. 17B shows a top view of the spring. The first end (402) of the spring (400) is mounted into the first mount (239) of the second collar (220) as further illustrated in FIG. 25.

Referring now to FIGS. 18A–C, alarm actuation means (500) is shown in various views. FIG. 18-A shows a bottom view of the alarm actuation means. FIG. 18-B shows a sectional side view of the alarm actuation means along line A—A and FIG. 18-C shows an oblique side view of the alarm actuation means. The alarm actuation means comprises actuation cap (501) having an outer surface (502). Actuation cap (501) is adapted to contact the normally open alarm circuit switch as more filly explained below. The actuation cap (501) further includes an inner surface (512) and two tabs (508) and (510).

Figure 19:
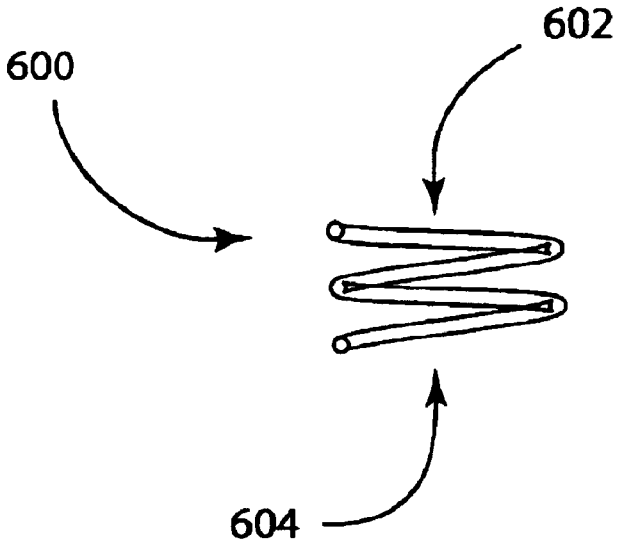
FIG. 19, comprises a views of the actuation spring.

Referring now to FIG. 19, there is shown second biasing means (600) comprising a spring adapted to sit inside the actuation cap body (501) at (510). Guide slots (506) and (507) on the collar (220) receive tabs (508) and (510) on the actuation cap body (500). The first end (602) of the spring (600) abuts surface (608) (illustrated in FIG. 16-D) and the second end (604) abuts surface (512) thereby biasing the actuation cap body (501) towards the alarm switch.

Figure 22:
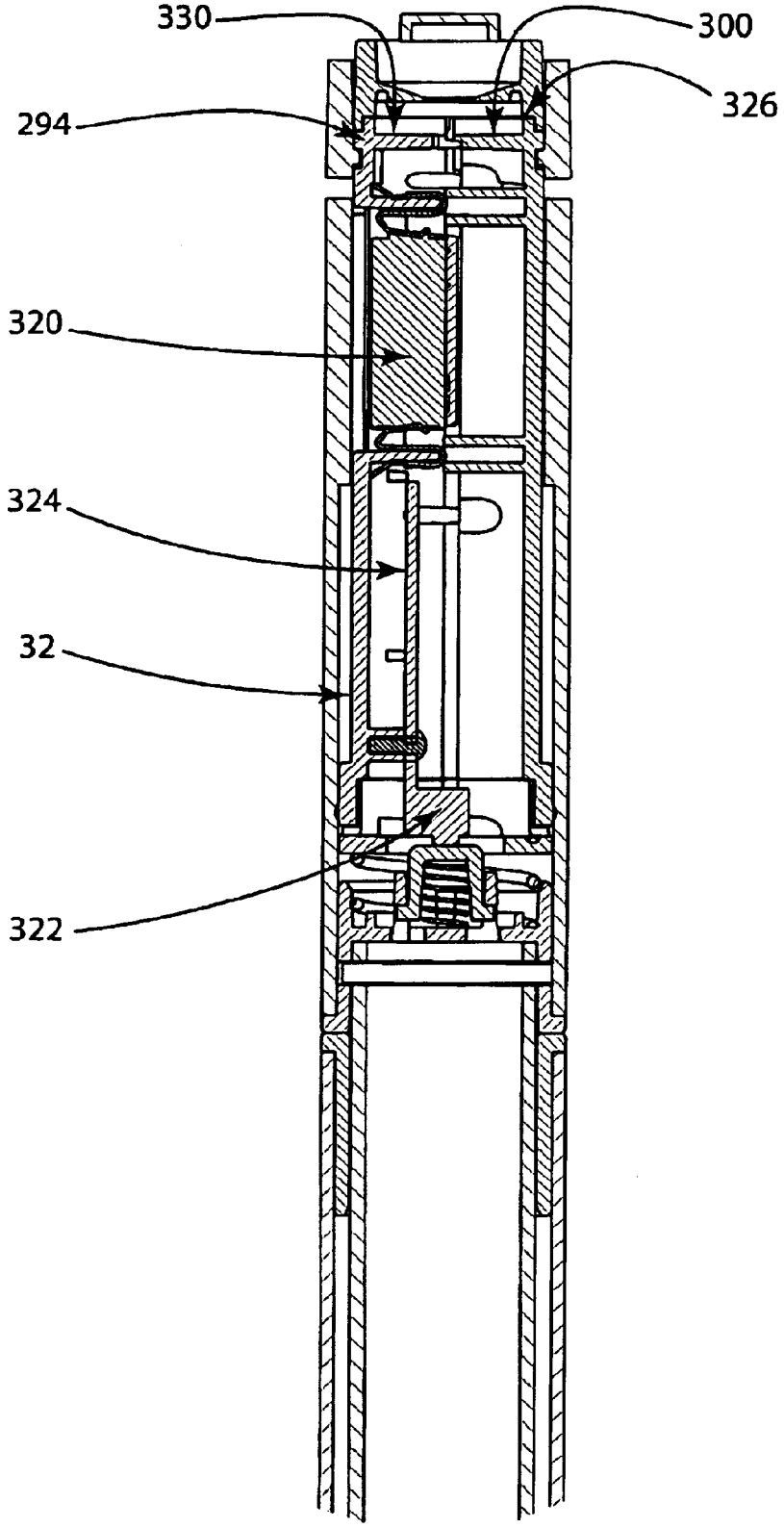
FIG. 22, is a sectional side view of the alarm circuit of one embodiment of the invention.

Referring now to FIGS. 20A–E and FIGS. 21A–E the elongate inner fourth tube (32) (illustrated in FIG. 2) comprises a first half body (262*a*) shown in FIGS. 20A–E and a second half body (262*b*) shown in FIGS. 21A–E. FIG. 20-A shows a top view of first half body (262*a*). FIG. 20-B shows a bottom view of first half body (262*a*). FIG. 20-C shows an oblique top view of first half body (262*a*). FIG. 20-D shows a first end view of first half body (262*a*) and FIG. 20-E shows a second end view of first half body (262*a*). FIG. 21-A shows a bottom view of second half body (262*b*) along line A—A. FIG. 21-B shows a side sectional view of second half body (262*b*). FIG. 21-C shows a top view of second half body (262*b*). FIG. 21-D shows an oblique view of second half body (262*b*) and FIG. 21-E shows a first end view of second half body (262*b*). FIGS. 20A–C clearly illustrates battery housing (315). To form the elongate inner fourth tube (32) the pins (317) on half body (262*a*) as shown in FIGS. 21B–C are pressed into pin holes (319) shown in FIG. 21A. Each half body has an outer diameter (264). Inner fourth tube (32) is adapted to house the alarm circuit (324) and the battery (320) as illustrated in FIG. 22. First half body (262*a*) comprises a first end (266*a*) and a second end (268*a*). Second half body (262*b*) comprises a first end (266*b*) and a second end (268*b*). First half body (262*a*) first end (266*a*) has a first half collar (270*a*) integral thereto. Second half body (262*b*) also has a second half collar (270*b*). The first and second collar halves (270*a*) and (270*b*) have an outer diameter (265) that is greater than the outer diameter (264) of the halve bodies (262*a*) and (262*b*) and less than the inner diameter of the elongate third outer tube. First half collar (270*a*) has biased lugs (272) and second half collar (270*b*) has biased lug (274). Each of the lugs has an embossment (276) and (277). The embossment is urged radially outwardly to engage in frictional contact with the inner surface of the elongate outer third tube, thereby permitting controlled axial telescoping movement of the inner fourth tube relative to the elongate third outer tube.

Referring still to FIGS. 20A–E and FIGS. 21A–E the first end (266*a*) of the first half body (262*a*) is partially enclosed by a first half ring (280*a*). Similarly, second half body (262*b*) is partially enclosed by a second half ring (280*b*). Each half ring has a bearing surface (282*a*) and (282*b*) respectively so that when the two half bodies (262*a*) and (262*b*) are joined each half ring joins to form a circular bearing surface adapted to bear against the first biasing means for biasing the alarm against a door or window. As well, each half ring (282*a*) and (282*b*) form to create a central hole (284) permitting the alarm actuating body (500) to engage the normally open switch of the alarm circuit as more fully explained below. The second end (268*a*) of the first half body (262*a*) and the second end of the second half body (262*b*) are is enclosed by a first half disc (290*a*) and a second half disc (290*b*) respectively. When the two half bodies are joined together to form inner fourth tube (32) the two half discs join to close that end of the tube save for an aperture in its centre (292). The second ends (268*a*) and (268*b*) further includes a third half ring (294*a*) and a fourth half ring (294*b*) depending therefrom. When the first half body and the second half body are joined, the third and fourth half rings join and together with the two half discs form a hollow (300).

Referring now to FIG. 22, the alarm circuit is illustrated. The alarm circuit is mounted within the elongate inner fourth tube (32) and includes a battery (320), a normally open switch (322) between the battery and a board mounted control circuit (324). The control circuit includes a transformer and a timer. The alarm circuit further comprises a sound producing audio transducer (326) operationally connected to the control circuit. The audio transducer (326) is mounted on the upper surface (296) (illustrated in FIG. 21-D) of the ring (294) and over the hollow (300) thereby forming a chamber (330) beneath the audio transducer.

Referring now to FIGS. 23A–D, the invention further comprises a sound amplification body (332) mounted over the audio transducer. FIG. 23-A shows a top view of the sound am plication body. FIG. 23-B shows a sectional side view of the sound amplification body along line A—A. FIG. 23-C shows a side view of the sound amplification body and FIG. 23-D shows an oblique bottom view of the sound amplification body. The sound amplification body comprising a cylindrical ring (334) having a top edge (336) and a bottom edge (338). A flange (340) depends downwards from the bottom edge (338) and is adapted to fit over and enclose the circular ring created by joined half rings (294*a*) and (294*b*) at the second end of inner fourth tube (32). The amplification body further includes a plano-concave disc (342) disposed within the cylindrical ring. The disc has an aperture (344) in its centre. The plane side (346) of the disc is positioned above and in operative relation to the audio-transducer (326) so that operation of the audio-transducer causes sympathetic vibration of the plano-concave disc thereby amplifying the sound emanating from the audio-transducer.

Referring now to FIGS. 24A–C, there is shown end cap (36) mounted over the amplification body (332). FIG. 24-A shows an oblique side view of the end cap. FIG. 24-B shows a sectional side view of the end cap along line A—A and FIG. 24-C shows a top view of the end cap. The end cap is fixed to the second end (268) of the elongate inner fourth tube (32) The end cap has an outer diameter equal to the outer diameter of the elongate outer third tube. The end cap has a plurality of openings (352) permitting sound to be transmitted.

Figure 25:
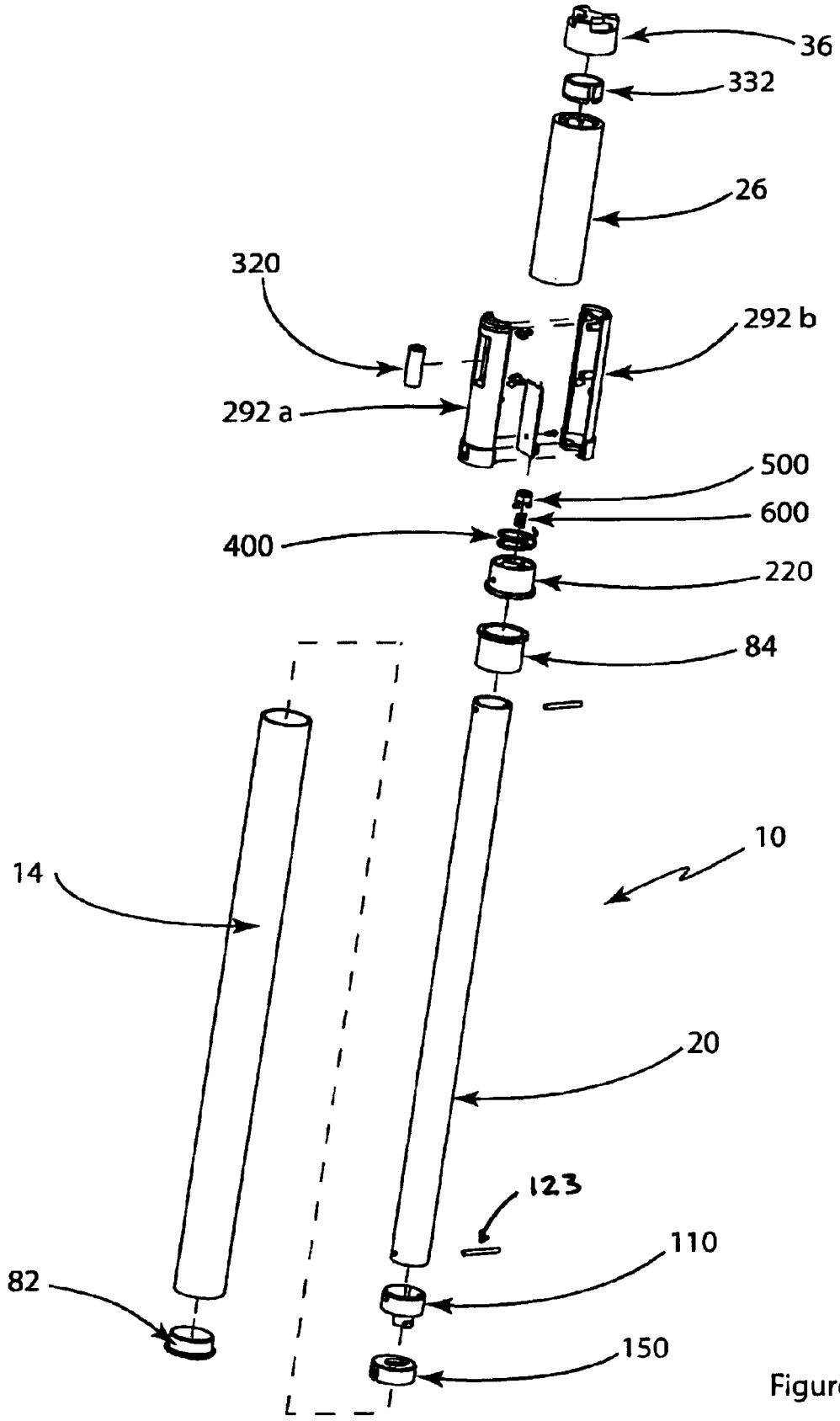
FIG. 25 is an assembly drawing of the invention showing the relationship between its various parts.

Referring now to FIG. 25, there is shown an assembly drawing illustrating the various components of my invention and the manner in which they are related and connected. All components of the invention, except the metal springs, are manufactured from molded thermoplastic material for easy manufacturing and assembly.

Figure 26:
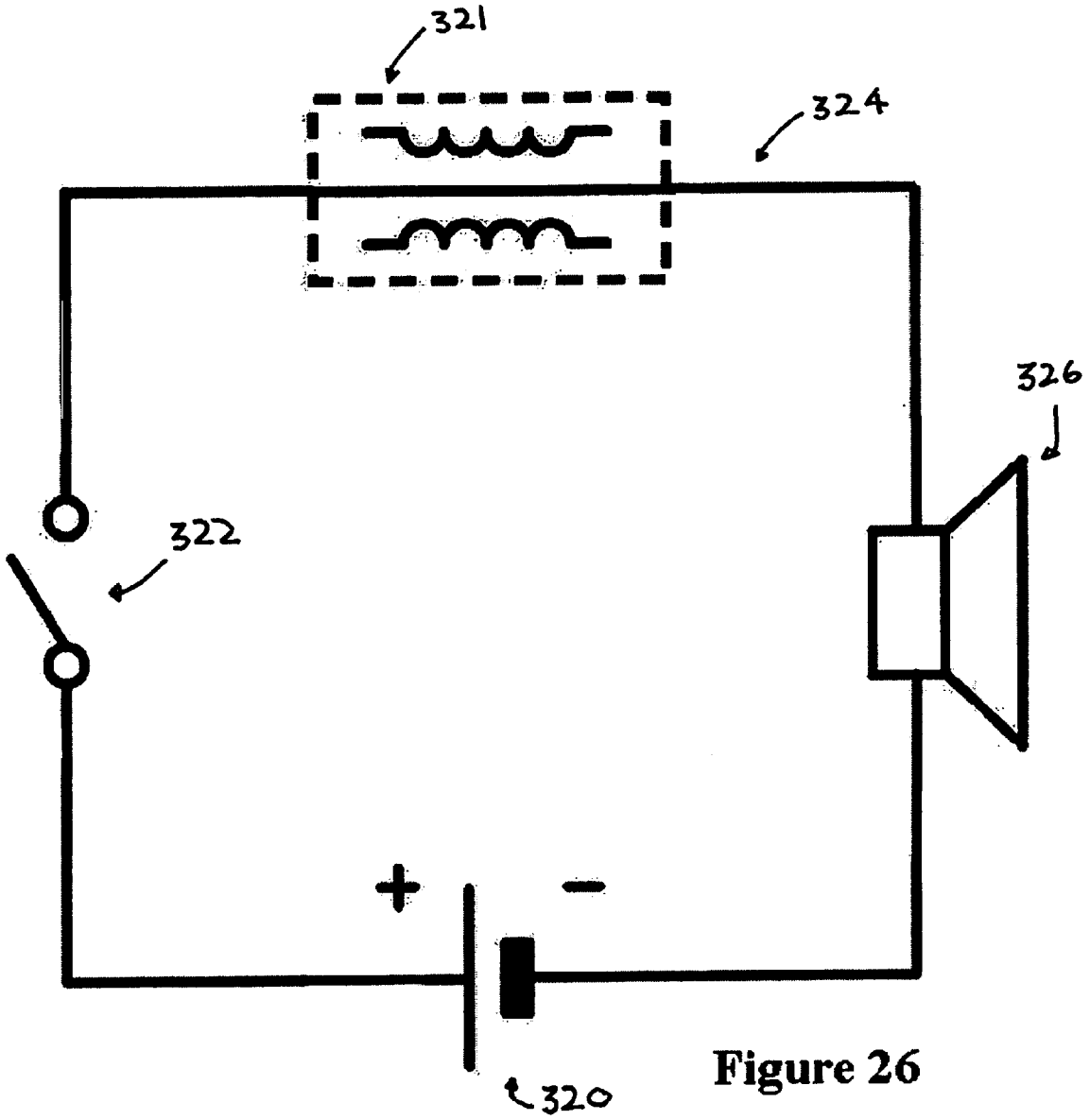
FIG. 26 is a circuit diagram for the basic invention.

Referring to FIG. 26, there is shown a simple circuit diagram of the control circuit (324) of one embodiment of the invention. The control circuit comprises a battery (320), normally open switch (322) and transformer (321) in order to power the audio transducer (326).

Figure 27:
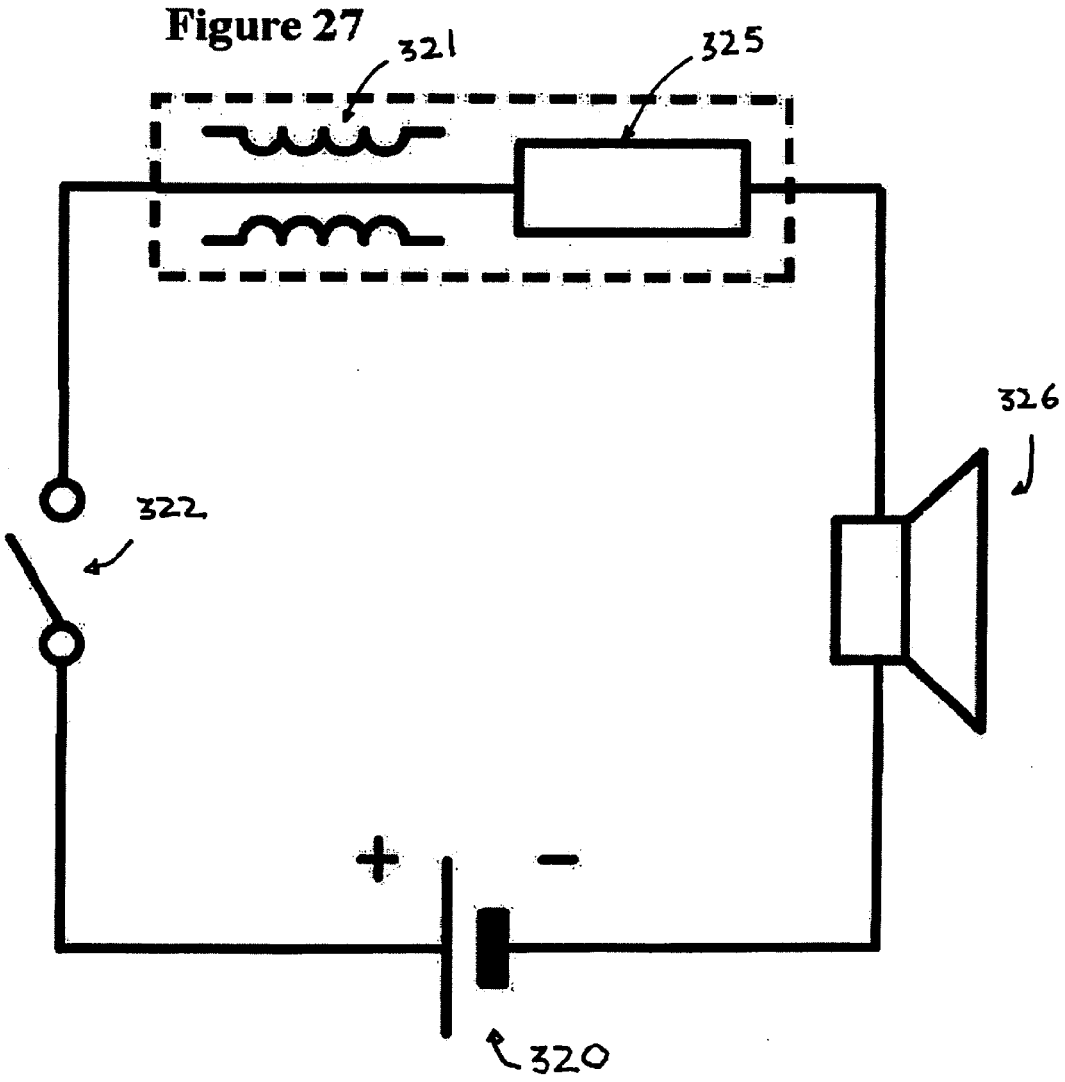
FIG. 27 is a circuit diagram for the invention including a timer relay.

Referring to FIG. 27, the preferred embodiment of the invention includes a timer (325) to limit the amount of time the audio transducer sounds so as to prevent depletion of the battery (320).

Figure 28:
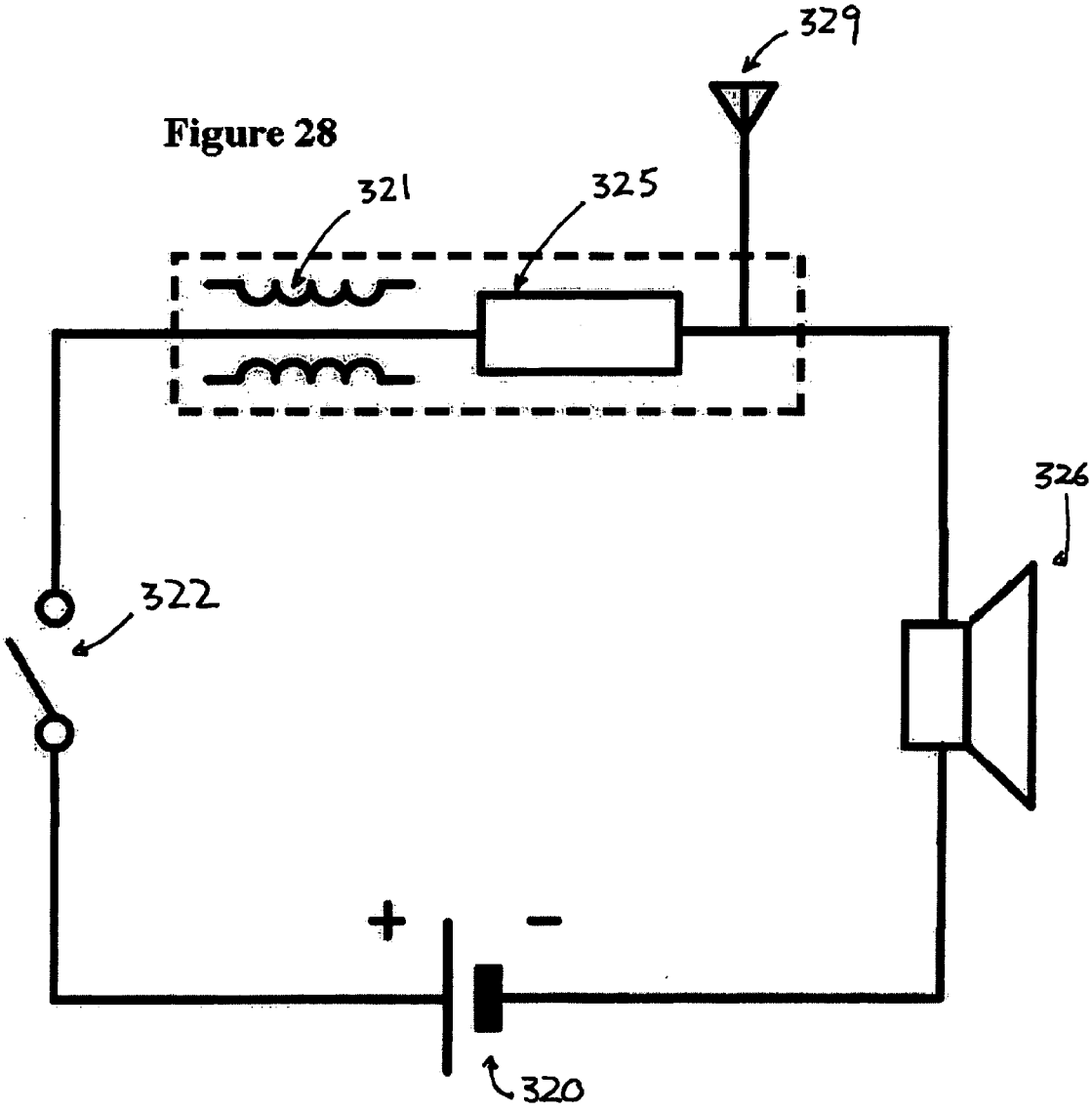
FIG. 28 is a circuit diagram for one embodiment of the invention for remote monitoring.

Referring to FIG. 28, there is shown another embodiment of my invention including means for remote monitoring the invention (329). Said means is adapted to actuate when the audio transducer is actuated for remote monitoring and would notify local authorities of an alarm situation. A person skilled in the art would understand such means to include, for example, radio transmission or connection to cable or telephone services.

Figure 29:
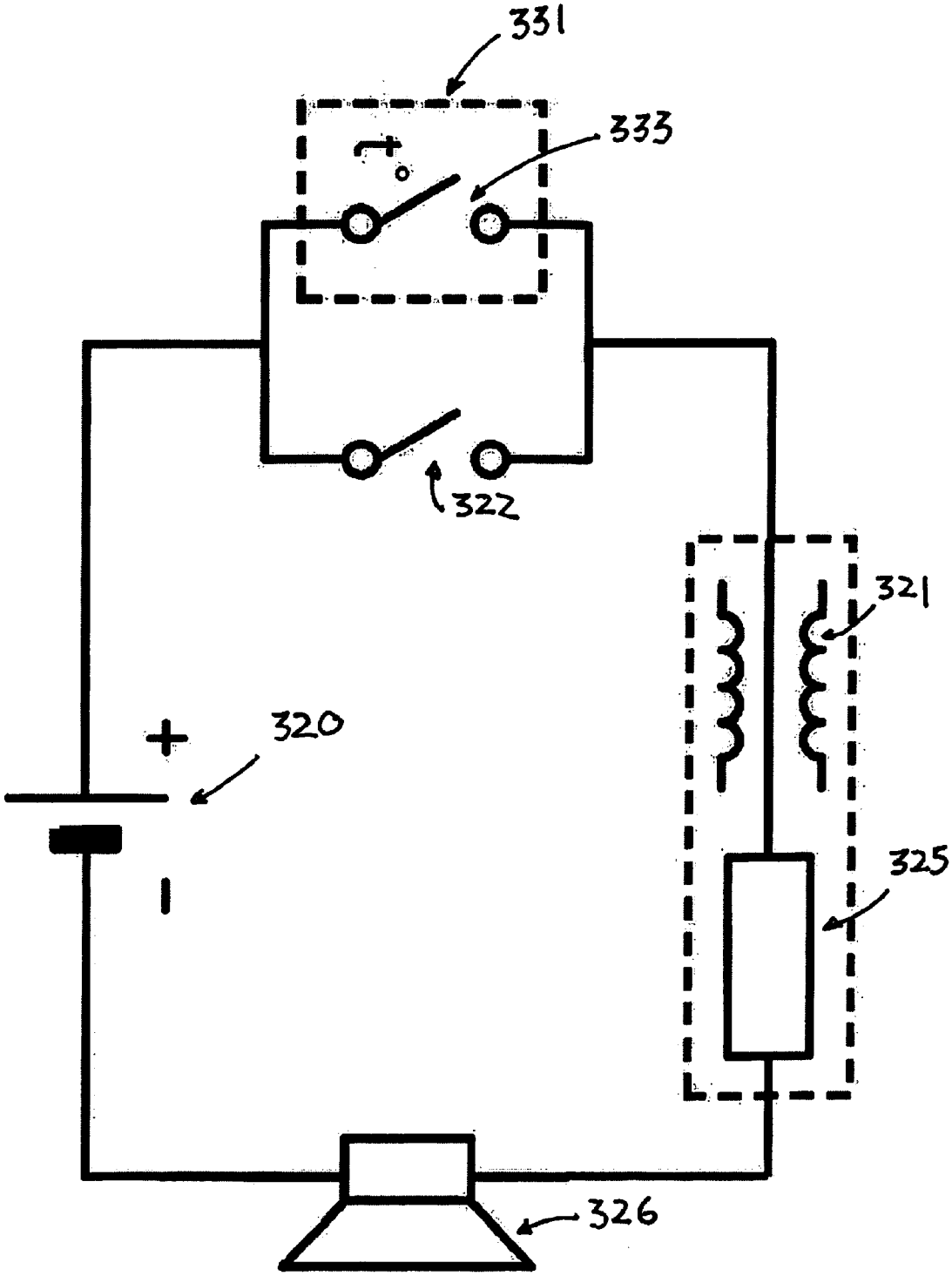
FIG. 29 is a circuit diagram for one embodiment of the invention with a heat sensor.

Referring to FIG. 29, there is shown another embodiment of my invention including a heat detector/motion sensor (331) actuated switch (333) for detecting body heat of any potential intruder in close proximity to the alarm.

Figure 30:
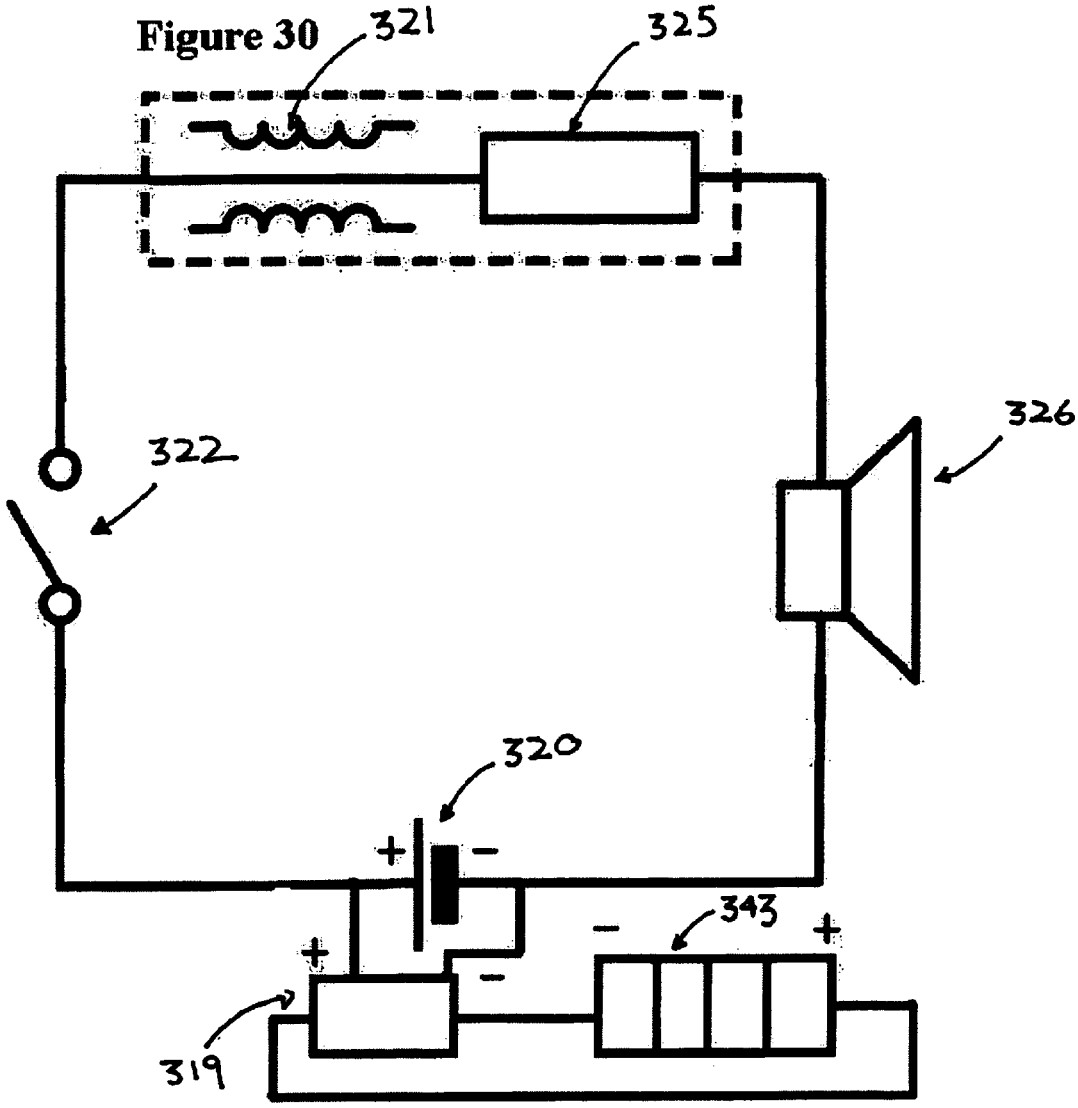
FIG. 30 is a circuit diagram for one embodiment of the invention with a photovoltaic battery charger.

Referring to FIG. 30 there is shown yet another embodiment of my invention that uses photovoltaic cells (343) to keep the battery charged.

Figure 31:
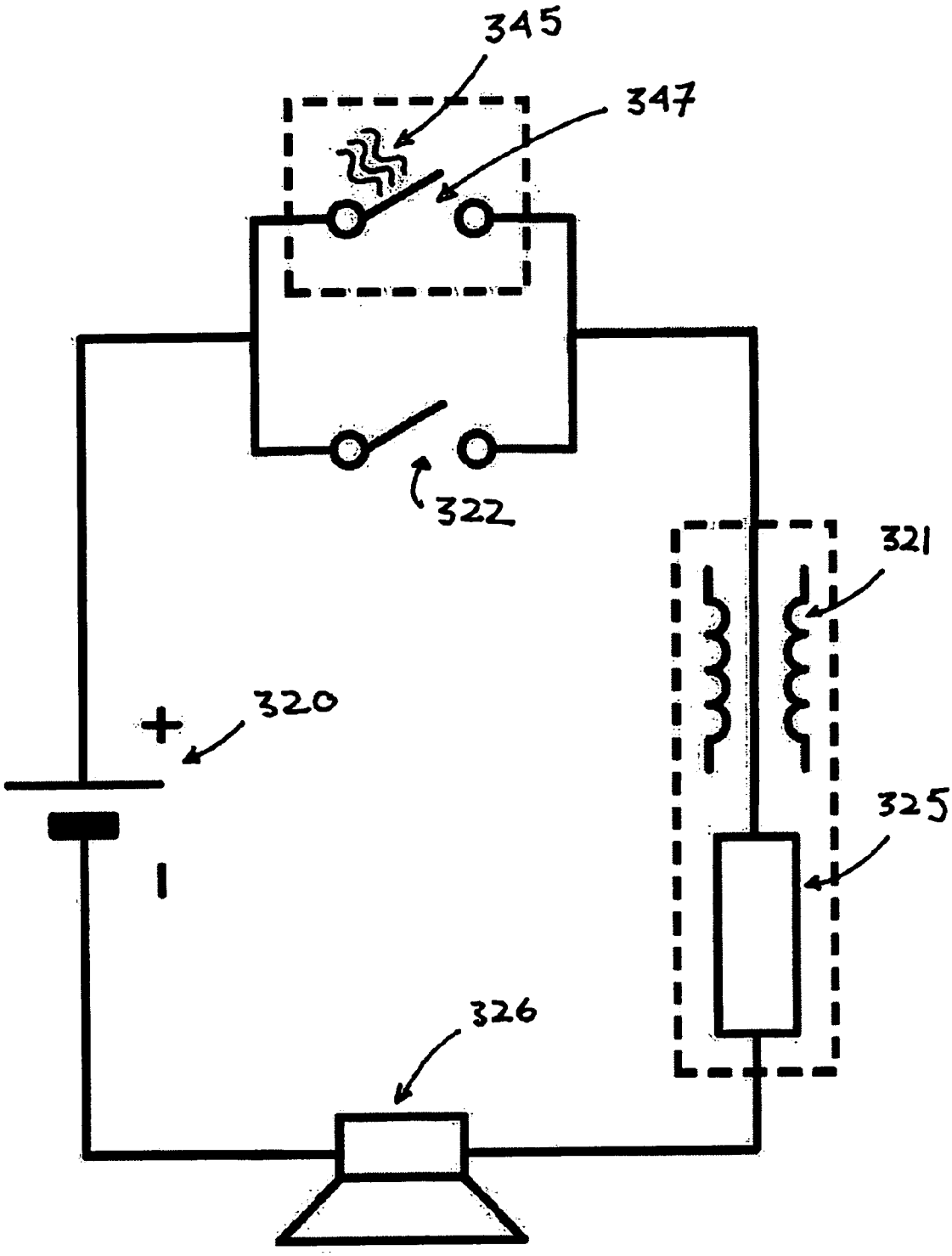
FIG. 31 is a circuit diagram for one embodiment of the invention with a vibration sensor.

Referring to FIG. 31 there is shown still another embodiment of my invention that includes anti-tampering means in the form of a vibration detector (345) to actuate a switch (347) in the event that the invention is tampered with.

Figure 32:
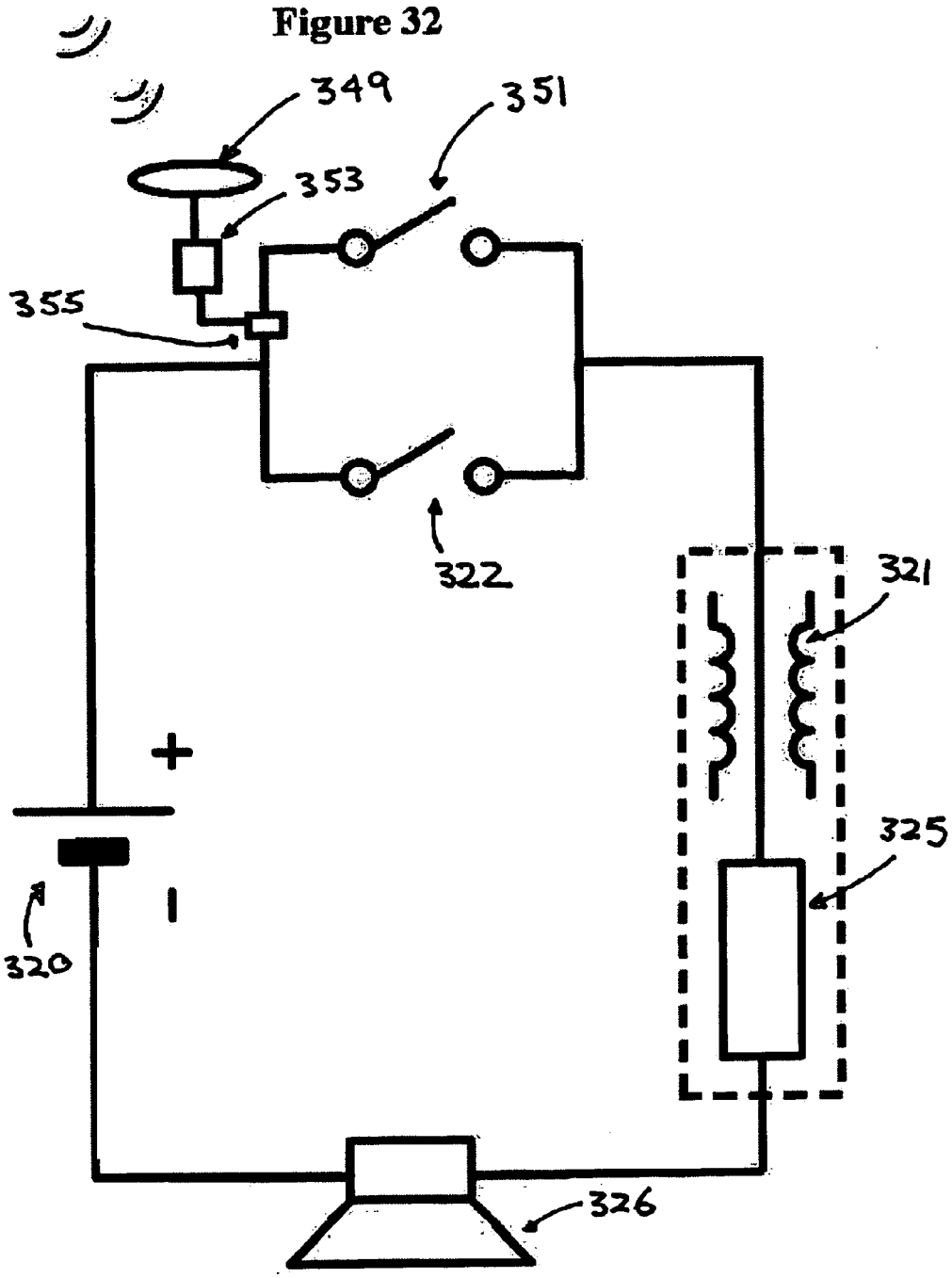
FIG. 32 is a circuit diagram for one embodiment of the invention with a sound detector.

Referring to FIG. 32 there is shown another embodiment of my invention that includes a sound detector (349) to detect the sound of breaking glass and actuate switch (351).

Figure 33A:
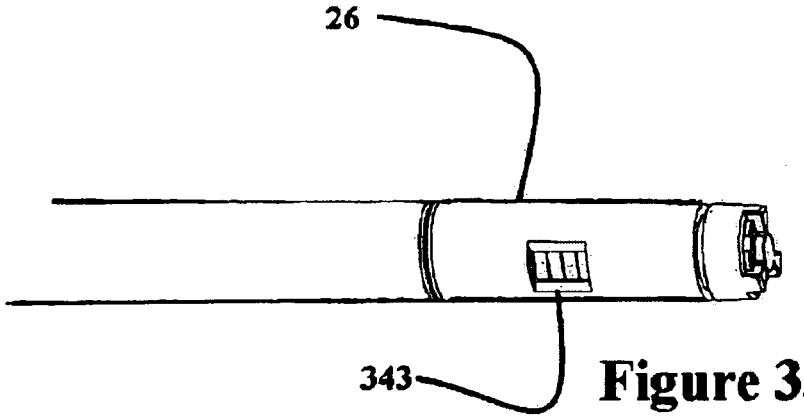
FIG. 33 are views of the invention with a solar panel, sound detector for breaking glass and heat/motion detector installed therein.
Figure 33B:
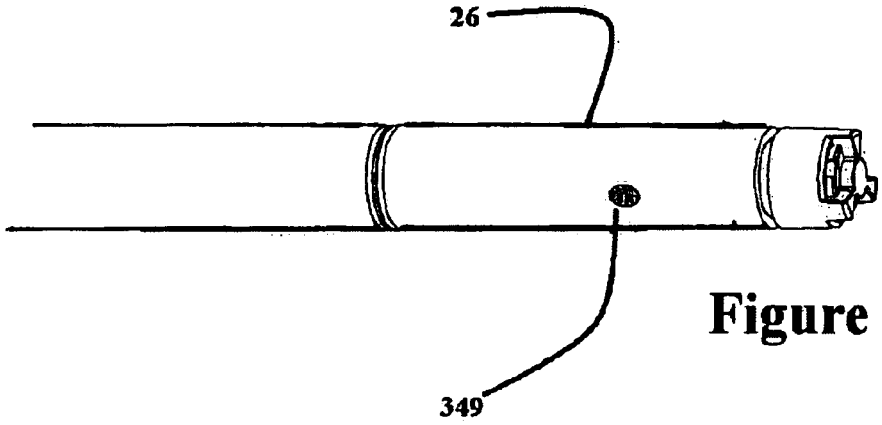
Figure 33C:
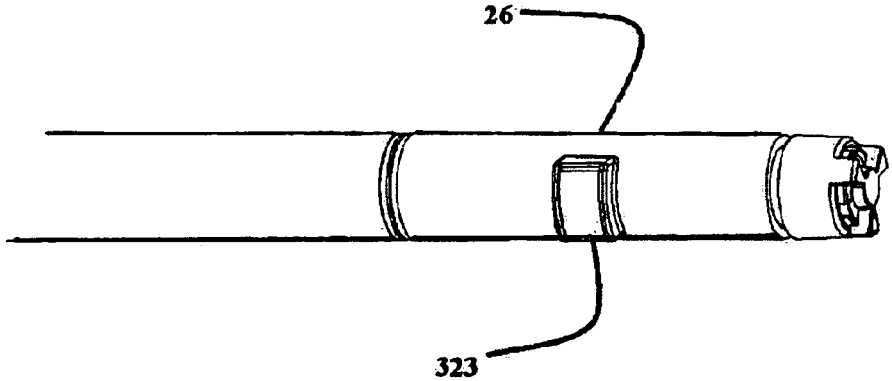

Referring to FIGS. 33A–C, there are shown three embodiment of my invention relating to FIGS. 30, 32 and 29 respectively. FIG. 33A shows the location of solar cells (343) within elongate outer third tube (26). FIG. 33B shows the location of a sound detector (349) to detect the sound of breaking glass located within elongate outer third tube (26). FIG. 33C shows the location of a heat sensor/motion sensor (323) located within elongate outer third tube (26).

Thus, having described the preferred embodiment of the invention and the best mode presently known for implementing the invention it is to be understood that certain changes could be made to the device disclosed herein without departing from what is considered to be the scope of this invention. Therefore, this specification is not to be taken in the limiting sense, but instead is to be taken and read for the purpose of interpreting the claimed invention as set forth in the following claims. Such claims and only such claims when interpreted in accordance with well established doctrine define the legal monopoly claimed herein.

What is claimed is:

1. An adjustable alarm device for windows and doors having an elongate tubular telescoping body comprising:

a. an elongate outer first tube having a first end and a second end;

b. an elongate inner second tube having a first end and a second end, said elongate inner second tube slidingly received within said elongate outer first tube, said second end of the elongate inner second tube extending from said first end of the elongate outer first tube;

c. means for releasably locking the elongate inner second tube positionally with respect to the elongate outer first tube;

d. an elongate outer third tube having a first end and a second end, said elongate outer third tube coupled to the second end of the elongate inner second tube by coupling means;

e. an elongate inner fourth tube having an outer surface, said elongate inner fourth tube slidingly disposed within the elongate outer third tube, the elongate inner fourth tube extending from said second end of the elongate outer third tube;

f. an alarm circuit disposed within the elongate inner fourth tube; and, g. alarm actuation means disposed within said coupling means.

2. The alarm device as claimed in claim 1, wherein the elongate outer first tube includes an inner surface, an outer surface, an inner diameter, an outer diameter, a longitudinal axis, a first end and a second end.

3. The alarm device as claimed in claim 2, wherein the elongate outer first tube further includes two apertures in said second end, said two apertures positioned opposite to each other.

4. The alarm device as claimed in claim 3 wherein the elongate inner second tube further includes an inner surface, an outer surface, an inner diameter, an outer diameter, a longitudinal axis, a first pair of apertures disposed in said first end, wherein each aperture in said first pair of apertures positioned opposite to the other, and a second pair of apertures disposed in said second end, wherein each aperture in said second pair of apertures is positioned opposite to the other.

5. The alarm device as claimed in claim 4, further comprising a first end plug fixed to the first end of the elongate outer first tube, wherein said first end plug is apertured to permit air flow therethrough.

6. The alarm device as claimed in claim 5, further comprising a first collar slideably mounted within the second end of the elongate outer first tube, said first collar comprising:

a. a flange member having a top surface and a bottom surface, said top surface adapted for engagement with the outer edge of the second end of the elongate outer first tube, said bottom surface adapted for engagement with the first end of the elongate third outer tube; and, b. a neck member having an inner surface and an outer surface, said neck member depending upwards from said flange, the neck member slideably mounted within the second end of the elongate outer first tube, the neck member having an inner diameter and an outer diameter, said outer diameter dimensioned so that the outer surface of the neck member is in sliding frictional contact with the inner surface of the elongate outer first tube, said inner diameter dimensioned so that the inner surface of the neck member is in frictional sliding contact with the outer surface of the elongate inner second tube.

7. The alarm device as claimed in claim 6, wherein the first collar further comprises means for fixing the first collar to the second end of the elongate outer first tube, said means comprising:

a. two depressible lugs positioned within the neck member, wherein each of said two depressible lugs are positioned radially opposite the other, and further wherein each of the two depressible lugs have outward projecting pins integral thereto, said pins adapted for insertion into the two apertures in the second end of the elongate outer first tube, so that when the first collar is inserted into the second end of the elongated outer first tube the pins engage the apertures thereby fixing the first collar to the outer tube; and, b. adhesive material applied between the outer surface of the first collar and the adjacent inner surface of the elongate outer first tube.

8. The alarm device as claimed in claim 7, further comprising a circular end cap fixed to the first end of the elongate second inner tube, said circular end cap comprising:

a. a base portion having a smooth flat outer surface and an inner surface;

b. a skirt portion; and, c. means for fixing the circular end cap to the first end of the elongate second inner tube, wherein the first end of the elongate second inner tube is slideably received into said skirt portion of the cap to abut against said end cap inner surface.

9. The alarm device as claimed in claim 8, wherein the circular end cap further comprises a camshaft mounted to the outer surface of the end cap base portion, said camshaft including:

a. a journal member having a longitudinal axis parallel to the longitudinal axis of the elongate second inner tube, a first end and a second end, said longitudinal axis of said journal member disposed off-centre from the longitudinal axis of the elongate second inner tube, said first end fixed to the outer surface of the end cap base portion, said second end free; and, b. two tabs radially mounted to the free second end of the journal member, each of said two taps mounted opposite to the other, each of the two tabs projecting away from the axis of the journal, each the two tabs having a lower bearing surface and an upper surface.

10. The alarm device as claimed in claim 9 wherein said means for fixing the circular end cap to the first end of the elongate second inner tube comprises:

a. a first pair of apertures disposed opposite to each other in the skirt of the circular end cap;

b. a second pair of apertures disposed opposite each other in the first end of the elongate second inner tube wherein when the second end of the elongate second inner tube is inserted into the skirt of the circular end cap, said second pair of apertures corresponds positionally to the first pair of apertures;

c. a pin member adapted to penetrate the first pair of apertures and the corresponding at second pair of apertures thereby pinning the circular cap to the first end of the elongate inner second tube, and, d. an adhesive material placed between the inner surface of the skirt portion of the circular end cap and the adjacent outer surface of the first end of the elongate inner second tube.

11. The alarm device as claimed in claim 10, wherein said means for releasably locking the elongate inner second tube positionally with respect to the elongate outer first tube comprises a circular cam body mounted onto the journal member, said cam body comprising:

a. a flat circular base member, said base member having smooth flat lower surface and an upper surface, said smooth flat lower surface adapted for sliding rotational engagement with the smooth flat outer surface of the circular end cap;

b. a skirt depending upwards from the outer circumference of the base member, said skirt having an outer diameter equal to the outer diameter of the circular end cap, the skirt having a smooth outer surface, said smooth outer surface adapted for entering into a releasably locking frictional engagement with the inner surface of the elongate outer first tube;

c. a contact finger positioned within the skirt, said contact finger depending downwards from the smooth flat upper surface of the circular cam body, the contact finger having a fixed end attached to the base member of the circular cam body and a free end, said free end terminating at the end of the skirt, the free end having a protuberance projecting laterally outwards there from therefrom and urged laterally outward into contact with the inner surface of the elongated outer first tube for frictional sliding contact therewith;

d. a socket penetrating the flat circular base member of the cam body, said socket having a circumferential profile identical to the circumferential profile of the journal member and the two tabs radially mounted thereto;

e. two partitioning members raised vertically from said upper surface of the flat circular base member of the cam body, said two partitioning members each having an upper edge and each transversing the upper surface of the flat circular base member, wherein each of the two partitioning members is positioned face to face across the socket and further wherein the profile of each of the two partitioning members follows the profile of the socket, so that when the socket of the cam body is received by the journal member and the two tabs mounted radially thereto, and rotated thereon, the smooth flat lower surface of the flat circular base member of the cam body is in rotational sliding contact with the smooth flat outer surface of the circular end cap, and the lower bearing surfaces of the two radially mounted tabs are in sliding contact with said upper edges of the two partitioning members.

12. The alarm device as claimed in claim 11, wherein the cam body has a first unlocked position with respect to the inner surface of the elongate outer first tube and a second locked position with respect to the inner surface of the elongate outer first tube, where:

a. in said first unlocked position, the cam body skirt is disengaged from the inner surface of the elongate outer first tube and the laterally projected protuberance is in frictional contact with the inner surface of the elongate outer first tube thereby permitting controlled sliding movement between the elongate outer first tube and the elongate inner second tube; and where, b. in said second releasably locked position, the cam body skirt is in tight frictional engagement with the inner surface of the elongate outer first tube thereby prohibiting any relative movement between the elongate outer first tube and the elongate inner second tube; and wherein, c. the cam body is moved from an unlocked position to a releasably locked position by twisting the elongate outer first tube and the elongate inner second tube in opposite directions thereby causing the cam body to rotate on the journal which in turn causes the cam body skirt to frictionally engage the inner surface of the elongated first outer tube; and wherein, d. the cam body is moved from a releasably locked position to an unlocked position by twisting the elongate outer first tube and the elongate inner second tube in directions opposite to the directions taken to lock the cam body.

13. The alarm device as claimed in claim 1, wherein the elongate outer third tube has an inner surface, an outer surface, an inner diameter, an outer diameter, a longitudinal axis, a first end and a second end, and wherein said elongate outer third tube has an inner diameter equal to the inner diameter of the elongate outer first tube and an outer diameter equal to the outer diameter of the elongate outer first tube, and further wherein, said first end of the elongate outer third tube includes two apertures each of which is positioned opposite the other.

14. The alarm device as claimed in claim 13, wherein the elongate outer third tube further includes a plurality of ribs spaced radially about the second end of the elongate outer third tube, said ribs extending longitudinally from the second end towards the first end, the ribs having an elevation from the inner surface of the elongate outer third tube sufficient to frictionally engage the outer surface of the elongate inner fourth tube thereby facilitating controlled movement of the elongate inner fourth tube relative to the elongate outer third tube.

15. The alarm device as claimed in claim 14, wherein the first end of the elongated outer third tube is coupled by coupling means to the second end of the elongate inner second tube, said coupling means comprising a second collar, said second collar comprising:

a. a flange member having a top surface and a bottom surface, said top surface adapted for engagement with the outer edge of the first end of the elongate outer third tube, said bottom surface adapted for abutting engagement with the top surface of the first collar;

b. a neck member having an inner surface and an outer surface, said neck member depending upwards from said flange member, the neck member slideably mounted within the first end of the elongate outer third tube, the neck member having an inner diameter and an outer diameter, said outer diameter dimensioned so that the outer surface of the neck member is in sliding frictional contact with the inner surface of the elongate outer third tube;

c. two pins depending radially from the neck member, each of said two pins disposed opposite the other, each of said pins adapted for insertion into said two apertures in the first end of the elongate outer third tube, so that when the third tube is inserted over the neck of the collar the two pins will engage the two apertures thereby fixing the collar to the outer tube; and, d. adhesive material applied between the outer surface of the neck member and the inner surface of the first end of the elongate outer third tube.

16. The alarm device as claimed in claim 15, wherein the second collar further comprises biasing means for biasing the alarm device against a window and alarm actuation means.

17. The alarm device as claimed in claim 1, wherein said elongate inner fourth tube has an outer diameter and is adapted to contain said alarm circuit.

18. The alarm device as claimed in claim 17, wherein the elongate inner fourth tube further comprises a first end and a second end, said first end having a collar integral thereto, said collar having an outer diameter greater than the outer diameter of the elongate inner fourth tube and less than the inner diameter of the elongate outer third tube, said collar having two biased lugs therein, said lugs each having an embossment thereon, said embossment urged radially outwardly to engage in frictional contact with the inner surface of the elongate outer third tube, thereby permitting controlled axial telescoping movement of the elongate inner fourth tube relative to the elongate outer third tube.

19. The alarm device as claimed in claim 18, wherein the first end of the elongate inner fourth tube is partially enclosed by a ring having a bearing surface adapted to bear against the biasing means for biasing the alarm against a door or window, said ring having a central hole permitting said alarm actuating device to engage the alarm circuit.

20. The alarm device as claimed in claim 19, wherein the second end of the elongate inner fourth tube is enclosed by a disc, said disc having an aperture in its centre, and wherein the second end of the elongate inner fourth tube further includes a ring fixed thereto and depending upwards from the second end said ring having an upper surface, the ring and said disc together forming a hollow.

21. The alarm device as claimed in claim 20, wherein the elongate inner fourth tube comprises a first half body and a second half body joined together.

22. The device as claimed in claim 1, wherein said alarm circuit comprises a battery, a normally open switch between the battery and a board mounted control circuit, all mounted within the elongate inner fourth tube, and wherein said control circuit includes a transformer and a timer.

23. The device as claimed in claim 22, wherein the alarm circuit further comprises a sound producing audio transducer operationally connected to the control circuit, said audio transducer mounted on the upper surface of the ring and over said hollow thereby forming a sound resonating chamber beneath the audio transducer.

24. The device as claimed in claim 23, wherein the alarm circuit further comprises a sound amplification body mounted over the audio transducer, said sound amplification body comprising a cylindrical ring having a top edge and a bottom edge, the sound amplification body further including a flange depending downwards from said bottom edge, said flange adapted to fit over and enclose the ring at the second end of the elongate inner fourth tube.

25. The device as claimed in claim 24, wherein said amplification body further includes a plano-concave disc disposed within said cylindrical ring, said disc having an aperture in its centre, the plane side of the disc positioned above and in operative relation to the audio-transducer so that operation of the audio-transducer causes sympathetic vibration of the piano-concave disc thereby amplifying sound produced from the audio-transducer.

26. The device as claimed in claim 25, further comprising an end cap mounted over the amplification body, said end cap fixed to the second end of the elongate inner fourth tube, the end cap having an outer diameter equal to the outer diameter of the elongate outer third tube, the end cap having a plurality of openings permitting sound to be transmitted.

27. The device as claimed in claim 26 further comprising photovoltaic cells for charging the battery using solar energy.

28. The device as claimed in claim 27, further comprising a sound receiver for detecting the sound of breaking glass and thereupon actuating the audio transducer.

29. The device as claimed in claim 28, further comprising anti-tampering means for detecting vibrations induced into the device and thereupon actuating the audio transducer.

30. The device as claimed in claim 29, further comprising a heat detector for the detection of movement of heat-generating objects proximate to the device and thereupon actuating the audio transducer.

31. The device as claimed in claim 30, further comprising means for remote monitoring of the device said means including means for notifying authorities upon actuation of the audio transducer.

* * * * *